US005826158A

United States Patent [19]

Hirano et al.

[11] Patent Number: 5,826,158

[45] Date of Patent: Oct. 20, 1998

[54] FINISHER AND METHOD OF STAPLING BY USING THE SAME

[75] Inventors: Ryo Hirano, Toyohashi; Shinji Wakamatsu, Toyokawa, both of Japan

[73] Assignee: Minolta Co., Ltd., Osaka, Japan

[21] Appl. No.: 947,208

[22] Filed: Oct. 8, 1997

[30] Foreign Application Priority Data

Mar. 12, 1997 [JP] Japan ..... 9-058126

[51] Int. Cl.[6] ..... G03G 15/00

[52] U.S. Cl. ..... 399/410; 270/58.08; 399/407

[58] Field of Search ..... 399/407, 408, 399/409, 410; 270/58.07, 58.08

[56] References Cited

U.S. PATENT DOCUMENTS

| | | | |
|---|---|---|---|
| 4,592,651 | 6/1986 | Oikawa et al. . | |
| 5,213,317 | 5/1993 | Mandel et al. | 399/408 X |
| 5,229,812 | 7/1993 | Toyama et al. | 270/58.08 X |
| 5,257,081 | 10/1993 | Kato et al. | 270/58.08 X |
| 5,320,336 | 6/1994 | Asami . | |
| 5,590,871 | 1/1997 | Okabe et al. | 399/410 X |

*Primary Examiner*—Sandra L. Brase
*Attorney, Agent, or Firm*—Sidley & Austin

[57] ABSTRACT

A finisher incorporating therein a stapler for accumulating a plurality of sheets and performing a stapling treatment on a bundle of accumulated sheets, comprising first sheet bundle conveying rollers disposed on the upstream side of the stapler relative to the direction of conveyance of the bundle of sheets and formed of a pair of rollers capable of converging toward and diverging from each other, second sheet bundle conveying rollers disposed on the downstream side of the stapler relative to the direction of conveyance of the bundle of sheets and formed of a pair rollers capable of converging toward and diverging from each other, and a sheet end detector disposed near the downstream side of the second sheet bundle conveying rollers and adapted to detect the leading end of the bundle of sheets in the direction of conveyance.

29 Claims, 25 Drawing Sheets

FINISHER AND METHOD OF STAPLING BY USING THE SAME

BACKGROUND OF THE INVENTION

1. Field of the Invention

This invention relates to a finisher connected to an image forming apparatus such as, for example, a copying machine or a printer and adapted to perform a stapling treatment on a plurality of sheets emanating from the image forming apparatus and a stapling method by the use of this finisher.

2. Description of the Related Art

The finisher is such an aftertreating device as is connected to an image forming apparatus like a copying machine or a printer and adapted to perform a stapling treatment on a plurality of sheets emanating from the image forming apparatus.

The conventional finishers designed for performing the stapling treatment of this kind have generally fulfilled the stapling treatment by introducing the sheets emanating from the copying machine or the printer temporarily into an aligning accumulating tray for the purpose of aligning the end parts of the sheets and then driving staples in the end parts of the sheets on the side thereof approximating closely to a stapler.

In recent years, the diversification of the needs on the part of the users has encouraged proposal of finishers endowed with the so-called center bind function which performs the stapling treatment on a central part in the direction of conveyance of a sheet (U.S. patent application Ser. No. 08/633,452 refers, for example).

The finishers possessed of this center bind function are enabled to perform the stapling treatment on the central part of a given bundle of sheets by adapting the stapler such that the bundle of sheets is conveyed arbitrarily between a staple driving part and a staple receiving part which are essential components of the stapler.

The adaptation of copying machines and printers for digital processings has advanced to a point where the information of original documents to be printed is temporarily stored in a memory, rearranged to vary the order of page numbers, and combined with newly introduced images and layouts relatively freely. In the case of a copying machine, for example, eight A4 original documents can be easily copied correctly in the order of page numbers by producing doubled-face copies on two A3 sheets and superposing the two A3 sheets and folding the superposed sheets in the center of sheet. A booklet resembling a weekly magazine is easily completed from the superposed A3 sheets by causing the finisher possessed of such a center bind function as mentioned above to perform the stapling treatment on the central part of the bundle of A3 sheets.

The finisher capable of the center bind described above, however, suffers an increase in the amount of conveyance of the bundle of sheets because it requires to convey the bundle of sheets from the accumulating tray serving the purpose of aligning the bundle of sheets until the central part of sheet comes to the stapling position. In the case of the center bind, therefore, it is difficult to convey sheets accurately to the stapling position. It has been found that the center bind incurs the inconvenience that the stapling position is prone to dispersion particularly when the bundle of sheets to be handled has a large thickness. This inconvenience similarly arises and poses a problem in the case of the trailing end bind which suffers an elongation in the distance of conveyance of the bundle of sheets.

SUMMARY OF THE INVENTION

It is, therefore, an object of this invention to provide a finisher which is capable of conveying a bundle of sheets and performing a stapling treatment on the bundle of sheets at an arbitrary position and further capable of performing the stapling treatment accurately without entailing deviation of the stapling position even in the case of the center bind or the trailing end bind which by nature elongates the distance of conveyance to the stapling position.

It is another object of this invention to provide a stapling method by the use of such a finisher.

According to an aspect of the invention, a finisher incorporating therein a stapling device for accumulating a plurality of sheets and performing a stapling treatment on a bundle of accumulated sheets comprises a first sheet bundle conveying device disposed on the upstream side of the stapling device relative to the direction of conveyance of the bundle of sheets and formed of a pair of rollers capable of being pressed against each other and separated from each other, a second sheet bundle conveying device disposed on the downstream side of the stapling device relative to the direction of conveyance of the bundle of sheets and formed of a pair of rollers capable of being pressed against each other and separated from each other, and a sheet end detecting device disposed near the downstream side of the second sheet bundle conveying device and adapted to detect the leading end of the bundle of sheets in the direction of conveyance. The stapling device may perform a stapling treatment on the bundle of sheets in the neighborhood of the leading end thereof, the trailing end thereof, or the center thereof in the direction of conveyance.

According to another aspect of the invention, a finisher incorporating therein a working device for accumulating a plurality of sheets and performing a work on a bundle of accumulated sheets comprises a first sheet bundle conveying device disposed on the upstream side of the working device relative to the direction of conveyance of the bundle of sheets, a second sheet bundle conveying device disposed on the downstream side of the working device relative to the direction of conveyance of the bundle of sheets, and a sheet end detecting device disposed in the neighborhood of the downstream side of the second sheet bundle conveying device and adapted to detect the leading end of the bundle of sheets in the direction of conveyance. The working device may perform a work on the bundle of sheets in the neighborhood of the leading end thereof, the trailing end thereof, or the center thereof in the direction of conveyance.

According to still another aspect of the invention, a method for stapling sheets comprises a step of accumulating a plurality of sheets emanating from an image forming apparatus, a step of nipping a bundle of accumulated sheets by the use of a first sheet bundle conveying device formed of a pair of rollers capable of converging toward and diverging from the bundle, a first step of conveying the nipped bundle of sheets, a step of receiving and stapling the bundle of sheets by the use of a stapling device, a second step of conveying the stapled bundle of sheets by the use of the first sheet bundle conveying device, a step of receiving and nipping the bundle of sheets by the use of a second sheet bundle conveying device formed of a pair of rollers capable of converging toward and diverging from the bundle of sheets, a step of separating the first sheet bundle conveying device from the bundle of sheets nipped by the second sheet bundle conveying device, and a third step of conveying the nipped bundle of sheets by the use of the second sheet bundle conveying device.

According to a further aspect of the invention, a stapling method comprises a step of accumulating a plurality of sheets emanating from an image forming apparatus, a step of nipping a bundle of accumulated sheets by the use of a first sheet bundle conveying device formed of a pair of rollers capable of converging toward and diverging from the bundle of sheets, a first step of conveying the nipped bundle of sheets, a step of receiving and stapling the bundle of sheets by the use of a stapling device, a step of nipping the stapled bundle of sheets by the use of a second sheet bundle conveying device formed of a pair of rollers capable of converging toward and diverging from the bundle of sheets, a step of separating the first sheet bundle conveying device from the bundle of sheets nipped by the second sheet bundle conveying device, and a second step of conveying the stapled bundle of sheets by the use of the second sheet bundle conveying device.

According to a still further aspect of the invention, a stapling method comprises a step of accumulating a plurality of sheets emanating from an image forming apparatus, a step of nipping a bundle of accumulated sheets by the use of a first sheet bundle conveying device formed of a pair of rollers capable of converging toward and diverging from the bundle of sheets, a first step of conveying the nipped bundle of sheets, a step of receiving and nipping the bundle of sheets by the use of a second sheet bundle conveying device formed of a pair of rollers capable of converging toward and diverging from the bundle of sheets, a step of separating the first sheet bundle conveying device from the bundle of sheets nipped by the second sheet bundle conveying device, a second step of conveying the nipped bundle of sheets by the use of the second sheet bundle conveying device, a step of receiving and stapling the bundle of sheets by the use of a stapling device, and a third step of conveying the stapled bundle of sheets by the use of the second sheet bundle conveying device.

DESCRIPTION OF THE PREFERRED EMBODIMENTS

The preferred embodiments of this invention will be described below with reference to the accompanying drawings.

Figure 1:
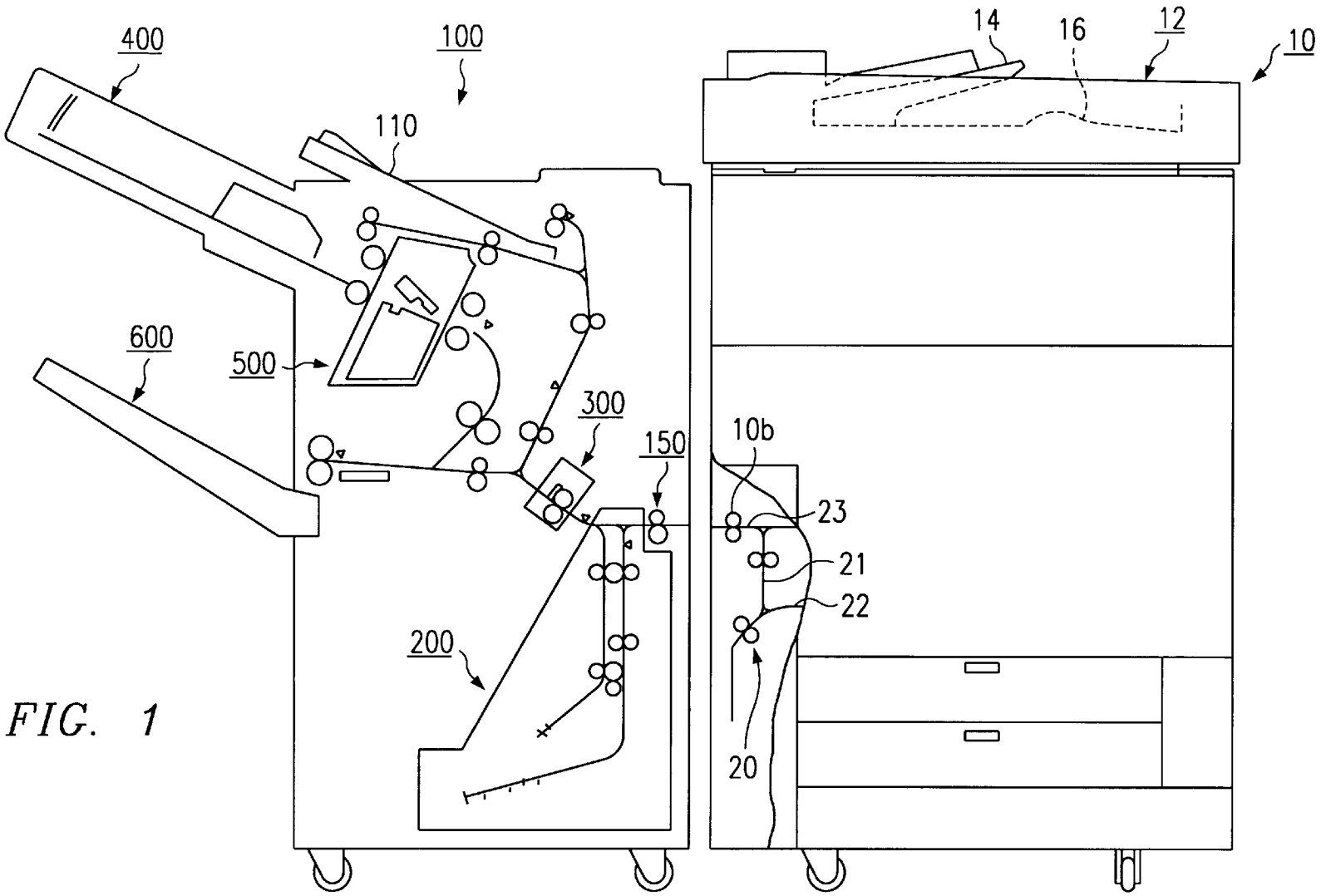
FIG. 1 is a diagram illustrating schematically the construction of a finisher embodying the present invention and a copying machine to which the finisher is connected.
Figure 2:
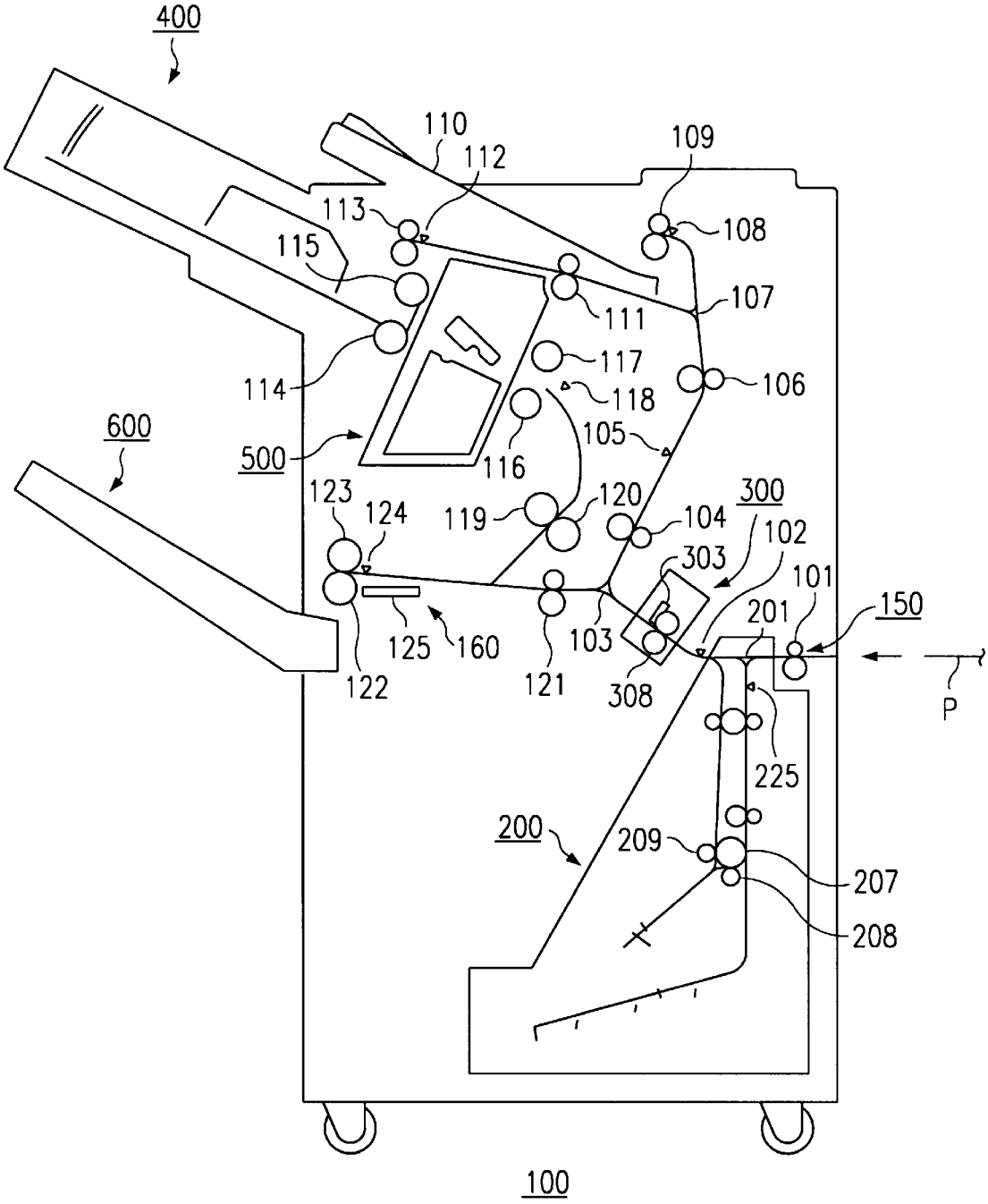
FIG. 2 is a diagram illustrating the overall construction of the finisher shown in FIG. 1 above.

FIG. 1 is a schematic diagram illustrating an embodiment having a finisher 100 according to this invention connected to a copying machine 10 as an image forming device and FIG. 2 is a schematic diagram illustrating the overall construction of the finisher 100.

In this specification, the direction of conveyance of a sheet will be referred to as "sheet conveying direction" and the direction perpendicular to this sheet conveying direction as "sheet conveying perpendicular direction." Then, the bearings of a sheet are defined as follows relative to the sheet conveying direction. The bearing of the sheet whose longitudinal direction falls along the sheet conveying direction will be referred to as "longitudinal" and the bearing of the sheet whose longitudinal direction perpendicularly crosses the sheet conveying direction as "lateral."

<<Copying machine 10>>

The illustrated copying machine 10 to which the finisher 100 is connected is what is called a digital copying machine. The digital copying machine reads and temporarily stores in a memory an image on the face of an original document and, when necessary, performs various editing treatments on the image. Then, it forms the image on a sheet by the well-known electrophotographic method and discharges copied sheets one by one from a sheet discharging part 10*b*.

The copying machine 10 has an automatic document feeder 12 (hereinafter referred to as "ADF") mounted thereon. This ADF 12 forwards one original document or a plurality of original documents (group of original documents) set on a tray 14 one by one onto a platen glass (not shown) of the copying machine 10 and, after the image thereon has been read out, discharges the original document onto a tray 16 to be piled thereon.

The copying machine 10 of the present embodiment is a so-called first page system which starts a copying motion from the first page onward of the group of original documents. On the tray 14 of the ADF 12, the group of original documents are set, with the first page turned upward. The copying machine of the first page system is at an advantage in obviating the necessity for designating or detecting the number, odd or even, of the original documents in the group as when the image on a single-face original document is to be copied on the obverse and reverse sides of one sheet and producing a quick copying motion.

As the original document is set on the platen glass as by the ADF 12, the image on the original document is read by an image reader (not shown) built in the copying machine 10, converted into digital data, and stored in a memory of the control part. The copying operation, prompted by the reading of the image data, is executed as combined with such necessary compilations as, for example, changing the order of pages, inverting an image, or producing copied images on both sides of a sheet.

In the vicinity of the discharging part 10*b* of this copying machine 10, a sheet inverting mechanism 20 for inverting a copied sheet upside down is disposed. This copying machine 10 comprises the three paths, i.e. a first path 21 for discharging from the discharging part 10*b* the sheet which has been inverted by the sheet inverting mechanism 20, a second path 22 for circulating within the copying machine 10 the sheet inverted by the sheet inverting mechanism 20 and producing a copy on the reverse face of the sheet opposite from the formerly copied face of the sheet, and a third path 23 for discharging the sheet directly from the discharging part 10*b* without being passed through the sheet inverting mechanism 20. The three paths mentioned above can be selectively switched arbitrarily.

The copying machine 10 decides whether or not the sheet intended for copying is to be folded, depending on operating mode set by the user and the size of sheet for copying, and emits the information obtained consequently to a finisher 100.

<<General construction and general operation of finisher 100>>

[General construction]

The finisher 100 of the present embodiment performs, either selectively or as suitably combined, such a folding work as doubly folding or triply folding (Z folding) in a cross section like a letter Z, as occasion demands, the sheets P discharged from the discharging part 10*b* of the copying machine 10 and conveyed one by one, a punching work for forming holes for filing in the edges of the sheets P, and a stapling treatment for binding a bundle of sheets with staples. Further, this finisher 100, on the assumption that it will be used as connected to the copying machine 10 or a printer as an image forming device of the first page system, determines the mode of conveyance of sheets P, the mode of piling of sheets P, or the mode of folding of sheets P.

The finisher 100, as is also illustrated in FIG. 2, comprises an introducing part 150 for introducing a sheet P discharged from the discharging part 10*b* mentioned above into the finisher 100, a sheet folding unit 200 for imparting a crease of fold to the sheets P conveyed one by one, a punching unit 300 for forming holes for filing in the sheets P conveyed one by one, an aftertreating tray part 400 for piling and aligning the sheets P before they undergo the stapling treatment, a stapler 500 disposed on the downstream side of the aftertreating tray part 400 and performing a stapling treatment on a bundle of piled and aligned sheets, an accumulating tray part 600 capable of receiving for storage therein a stapled bundle of sheets or an unstapled sheet, and a discharged sheet tray part 110 for piling the sheets P discharged from the finisher 100.

The introducing part 150 is provided with conveying rollers 101 and a guide plate (not shown). The sheet folding unit 200 is provided with a plurality of sheet folding rollers 207, 208, and 209 and is adapted to nip the sheet P between the sheet folding rollers 207, 208, and 209 and impart a crease of fold therein. The stapler 500 is so constructed as to be moved in the two directions, i.e. the sheet conveying direction and the sheet conveying perpendicular direction of the bundle of sheets piled and aligned in the aftertreating tray part 400.

For the purpose of conveying the sheet P by means of rollers to various components in the finisher 100, conveying rollers 104, 106, 111, and 121 are disposed along the sheet conveying paths. For the purpose of conveying the bundle of sheets, sheet bundle conveying rollers 114 and 115, 116 and 117, and 119 and 120 are disposed along the conveying paths for the sheet bundle. At the terminal positions of the conveying paths, discharge rollers 109 for discharging the sheet P into the discharged paper tray part 110, discharge rollers 113 for discharging the sheet P into the aftertreating tray part 400, and discharge rollers 122 and 123 for discharging the sheet P or the sheet bundle into the accumulating tray part 600.

For the purpose of changing the destination of the sheet P being conveyed, a plurality of switch claws 201, 103, and 107 are disposed on the sheet conveying paths. The switch claw 201 which is disposed between the introducing part 150 and the sheet folding unit 200 decides whether or not the sheet P is sent into the sheet folding device 200. The punching unit 300 is disposed on the downstream side of the switch claw 201 and is enabled to perform a punching work on the sheet conveyed from the introducing part 150 or on the sheet conveyed from the sheet folding unit 200. The switch claw 103 which is disposed on the downstream side of the punching unit 300 decides whether the sheet P is conveyed to the discharged paper tray part 110 or the aftertreating tray part 400 or the sheet P is directly conveyed to the accumulating tray part 600. The switch claw 107 which is disposed on the downstream side of the switch claw 103 decides whether the sheet P is conveyed to the discharged paper tray part 110 or to the aftertreating tray part 400.

For the purpose of timing the driving or stopping of the various components in the finisher 100, a plurality of sensors 102, 105, 108, 112, 118, 124, and 225 for detecting the sheet P are disposed on the sheet or sheet bundle conveying paths.

The finisher 100 of the present embodiment is further provided with a guide unit 160 for preventing defective discharge into the accumulating tray part 600 of the bundle of sheets which has undergone a center bound stapling treatment like a weekly magazine. The guide unit 160 illustrated in the diagram is composed of an auxiliary guide member 125 adapted to support the lower side of the bundle of sheets discharged from between discharge rollers 122 and 123 and allowed freely to advance and retreat.

The accumulating tray part 600 is enabled to move vertically according to the amount of the sheet or the bundle of sheets to be discharged by the well-known method. This tray part 600 is moved downward gradually as the amount of the sheet or the bundle of sheets grows large.

[General operation]

The finisher 100 is capable of performing a plurality of aftertreatments (folding, punching, and stapling works) on the sheets as described above. The user of the finisher 100, therefore, is enabled to select freely these treatments by the use of an operating panel of the copying machine 10.

When the user selects a mode excluding a stapling treatment, for example, the sheet folding unit 200 and the punching unit 300 perform the treatments selected by the user on the sheet P discharged from the discharging part 10*b* of the copying machine 10 and the sheet P having undergone the treatments is conveyed by means of rollers to the discharged paper tray part 110 or the accumulating tray part 600 and placed on these tray parts 110 and 600.

When the user selects a mode including a stapling treatment, similarly to the mode excluding the stapling treatment, first the sheet folding unit 200 and the punching unit 300 perform the treatments selected by the user on the sheet P. Then, a prescribed number of sheets P which have been folded or punched are conveyed in the direction of the aftertreating tray part 400 and sequentially piled and aligned on the aftertreating tray part 400. Thereafter, the sheets P which have been piled and aligned are sent in the form of one bundle of sheets by means of rollers to the stapler 500.

After the stapler 500 has bound the bundle of sheets by driving staples in the bundle at the positions selected by the user, the stapled bundle of sheets is conveyed by the rollers in the direction of the accumulating tray part 600 and placed therein.

In this finisher 100, the sheet folding unit 200 and the punching unit 300 which treat the incoming sheets one by one are disposed further on the upstream sides of the most upstream branching points of the conveying paths (the positions for the disposition of the switch claw 103) reaching a plurality of sheet piling parts (referring collectively to the discharged paper tray part 110, the aftertreating tray part 400, and the accumulating tray part 600). The sheets which have undergone the sheet treatments (folding and punching works in this embodiment) one by one, therefore, can be discharged to any of the sheet piling parts.

Now, the stapler and the conveying system, i.e. essential mechanisms for the finisher 100, according to this invention will be described in detail below.

<<Aftertreating tray part 400>>

Figure 3:
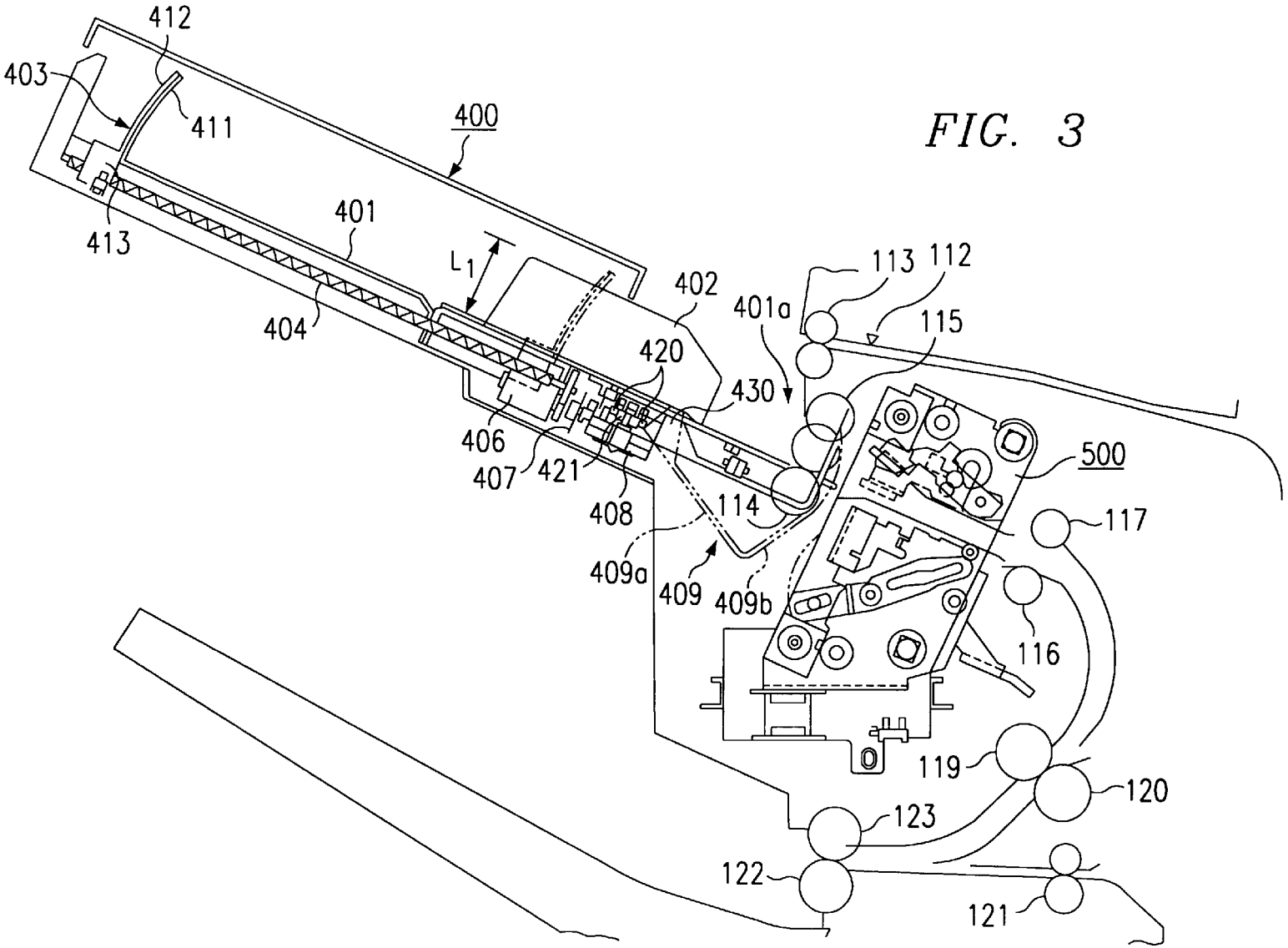
FIG. 3 is a cross section illustrating schematically the construction of an aftertreating tray part shown in FIG. 2 above and a stapler disposed in the downstream thereof.

FIG. 3 is a cross section illustrating schematically the construction of an aftertreating tray part 400 and a stapler 500 disposed in the downstream thereof.

For the sake of the convenience of description, the alignment along the direction of conveyance of sheet from the aftertreating tray part 400 to the stapler 500 (FD direction) will be referred to as "FD alignment" and the alignment along the direction of width of the conveyance of sheet which is a direction perpendicular to the conveyance of sheet (CD direction) will be referred to as "CD alignment."

The aftertreating tray part 400 comprises an aftertreating tray 401 for temporarily storing in the face-down state the sheet which has been already inverted upside down in the upstream part and discharged by discharging rollers 113, a leading end stopper 409 for effecting the FD alignment of the sheet disposed in a sheet discharging outlet 401*a* of the aftertreating tray 401, a pair of lateral aligning plates 402 for effecting the CD alignment of the sheet discharged by the discharging rollers 113, a trailing end stopper 403 for allowing collision thereagainst of the leading end of the sheet discharged from the discharging rollers 113 thereby causing the FD alignment by the leading end stopper 409 to proceed stably, and first sheet bundle conveying rollers 114 and 115 for conveying a prescribed number of sheets stored in the aftertreating tray 401 as one bundle to the stapler 500.

The aftertreating tray 401 is disposed with the sheet discharging outlet 401*a* thereof inclined downward at a prescribed angle. A pair of laterally aligning plates (hereinafter referred to occasionally as "paired lateral aligning plates") 402 are freely movably disposed symmetrically along the CD direction and the trailing end stopper 403 is disposed freely movably along the FD direction. The FD alignment and the CD alignment are carried out each time a sheet is introduced for storage into the aftertreating tray 401. The first sheet bundle conveying rollers 114 and 115 consist of a lower roller 114 and an upper roller 115 and are constructed such that the upper roller 115 is moved substantially in the vertical direction and freely converged toward or diverged from the lower roller 114.

The paired lateral aligning plates 402 are each formed of a plate member having a height (L1) larger than the largest height of the bundle of sheets which can be stored on the aftertreating tray 401 and are severally attached to a pair of racks 420 mounted on the reverse face side of the aftertreating tray 401 along the CD direction. The racks 420 are mounted as opposed to each other across a gear 421 which is rotationally driven by a stepping motor 408. By the rotation of the gear 421, the paired lateral aligning plates 402 are symmetrically moved along the CD direction. To be specific, the paired lateral aligning plates 402 are synchronously moved toward each other during the normal rotation of the stepping motor 408 and synchronously moved away from each other during the reverse rotation.

The paired lateral aligning plates 402 have two waiting positions, i.e. a first waiting position and a second waiting position. The first waiting position is where they are kept waiting before the sheet is discharged by the discharging rollers 113. Then, the second waiting position, which is varied by the size of the sheet to be discharged and slightly wider than the size of the sheet, is where they are kept waiting for the sheet to be discharged by the discharging rollers 113. The paired lateral aligning plates 402 are freely moved between the first waiting position and the second waiting position and the aligning position for effecting the CD alignment of the sheets discharged by the discharging rollers 113.

A plurality of sensors to be used for locating the paired lateral aligning plates 402 are provided on the lower face of the aftertreating tray 401 and dousers for intercepting the beams of light from the sensors are integrally mounted on the paired lateral aligning plates 402. The location of the first and the second waiting positions is effected by the relevant dousers intercepting the beams of light from the sensors. Then, the location of the aligning position of the paired lateral aligning plates 402 is attained by controlling the number of pulses to be given to the stepping motor 408 and consequently controlling the amount of rotation of the gear 421.

The leading end stopper 409, shaped nearly like a letter L, is composed of a bottom plate part 409*a* and a blocking part 409*b* raised from the leading end of the bottom plate part 409*a* and mounted on the lower face of the aftertreating tray 401 so as to be freely rotated about a fulcrum 430 formed on the bottom plate part 409*a*. The leading end stopper 409 is urged as by a spring and pressed against a protrusion on the lower face of the aftertreating tray 401. The blocking part 409*b* of the leading end stopper 409 constitutes itself the standard aligning edge in the direction of conveyance of sheet for the sheet being received for storage in the aftertreating tray 401. When a link arm (not shown) connected to the bottom plate part 409*a* is pulled backward by a solenoid, the blocking part 409*b* of the leading end stopper 409 is moved downward as rotated arcuately about the fulcrum 430 and the sheet discharging outlet 401*a* serving the purpose of delivering the bundle of sheets to the stapler 500 is opened.

The trailing end stopper 403 comprises a platelike member 412, a sponge member 411 pasted to that of the opposite faces of the platelike member 412 which allows collision thereagainst of the sheet, and a structural member 413 for supporting the platelike member 412. The nearly upper half of the platelike member 412 mentioned above forms the shape of "R" bent more or less toward the sheet discharging outlet 401*a* from the direction perpendicular to the upper face of the aftertreating tray 401.

The following advantage is derived from forming the platelike member 412 of the trailing end stopper 403 in the shape of "R". When the sheet is conveyed from the aftertreating tray 401 toward the stapler 500, the trailing end of the sheet along the direction of conveyance of sheet (corresponding to the leading end of the sheet being discharged from the discharging rollers 113) infallibly collides stably against the platelike member 412 of the trailing end stopper 403, without reference to the number of sheets already delivered for storage in the aftertreating tray 401, the sheet size, or the presence or absence of a folding treatment. Since this collision imparts a motion to the sheet in the direction opposite to the direction of discharge mentioned above, the leading end of the sheet along the aforementioned direction of conveyance of sheet collides against the leading end stopper 409 and consequently ensures the FD alignment. A Z-folded sheet, owing to the crease of fold, assumes a state such that the trailing end of the sheet along the aforementioned direction of conveyance of sheet slightly floats up. Owing to the use of the platelike member 412 whose upper part forms the shape of "R", the bundle of sheets including the Z-folded sheets can be uniformly depressed and brought into contact with the leading end stopper 409 and can be infallibly corrected to eliminate a deviation in the direction of conveyance of sheet which is possibly imparted to the bundle of sheets including the Z-folded sheets during the conveyance thereof toward the stapler 500.

The structural member 413 of the trailing end stopper 403 is meshed with a spiral shaft 404 mounted at the center of the lower face of the aftertreating tray 401 as extended along the direction of conveyance of sheet. This spiral shaft 404 is connected through the medium of a drive transmitting part (not shown) formed of a gear train to a drive motor 406 formed of a DC motor. The trailing end stopper 403 is moved forward or backward in a proper amount along the direction of conveyance of sheet by rotationally driving the drive motor 406 properly in the normal or reverse direction and consequently rotating the spiral shaft 404.

<<Stapler 500>>

[Construction of stapler 500]

Figure 4:
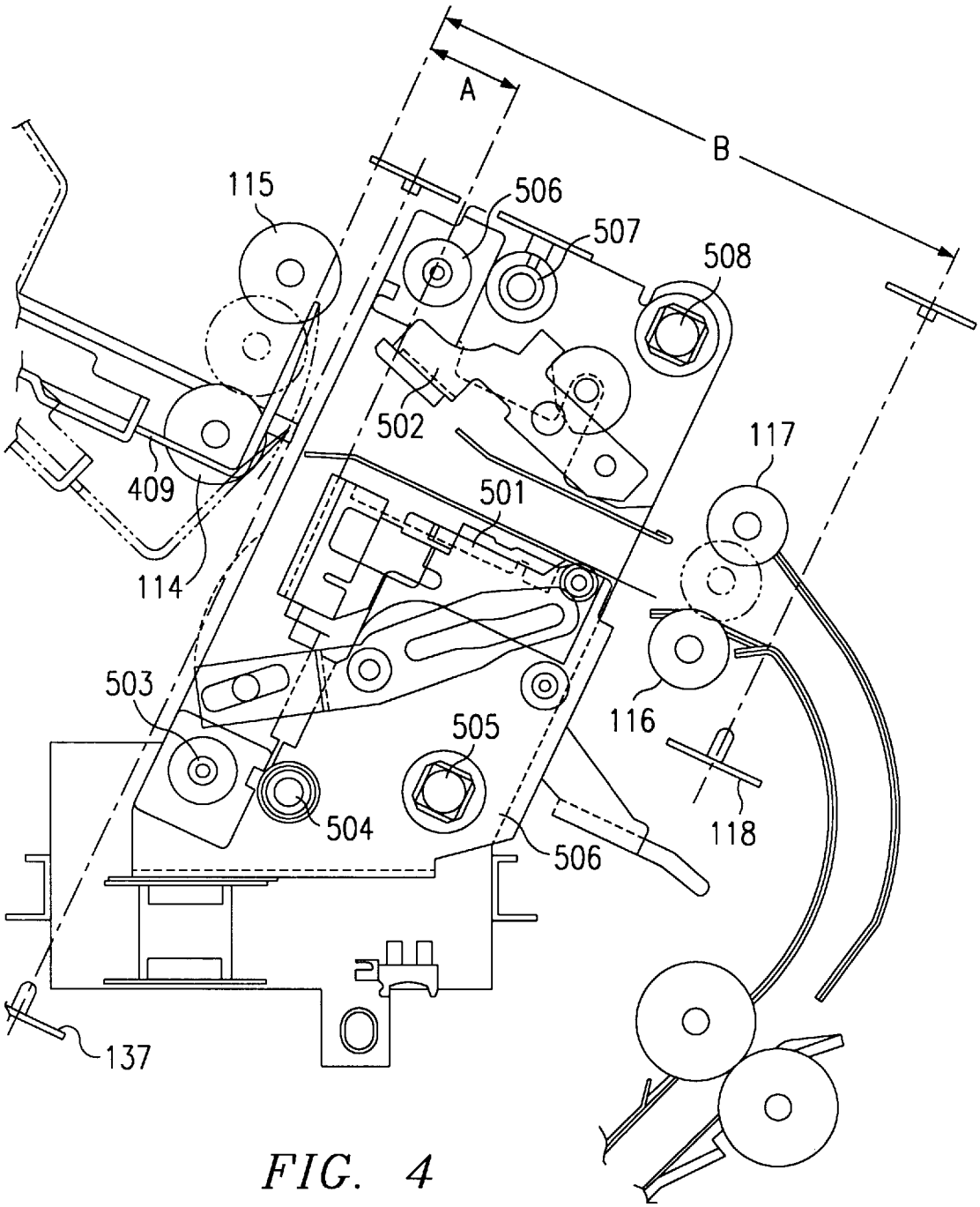
FIG. 4 is a cross section illustrating the construction of the stapler shown in FIG. 2 above and the vicinity thereof.
Figure 5:
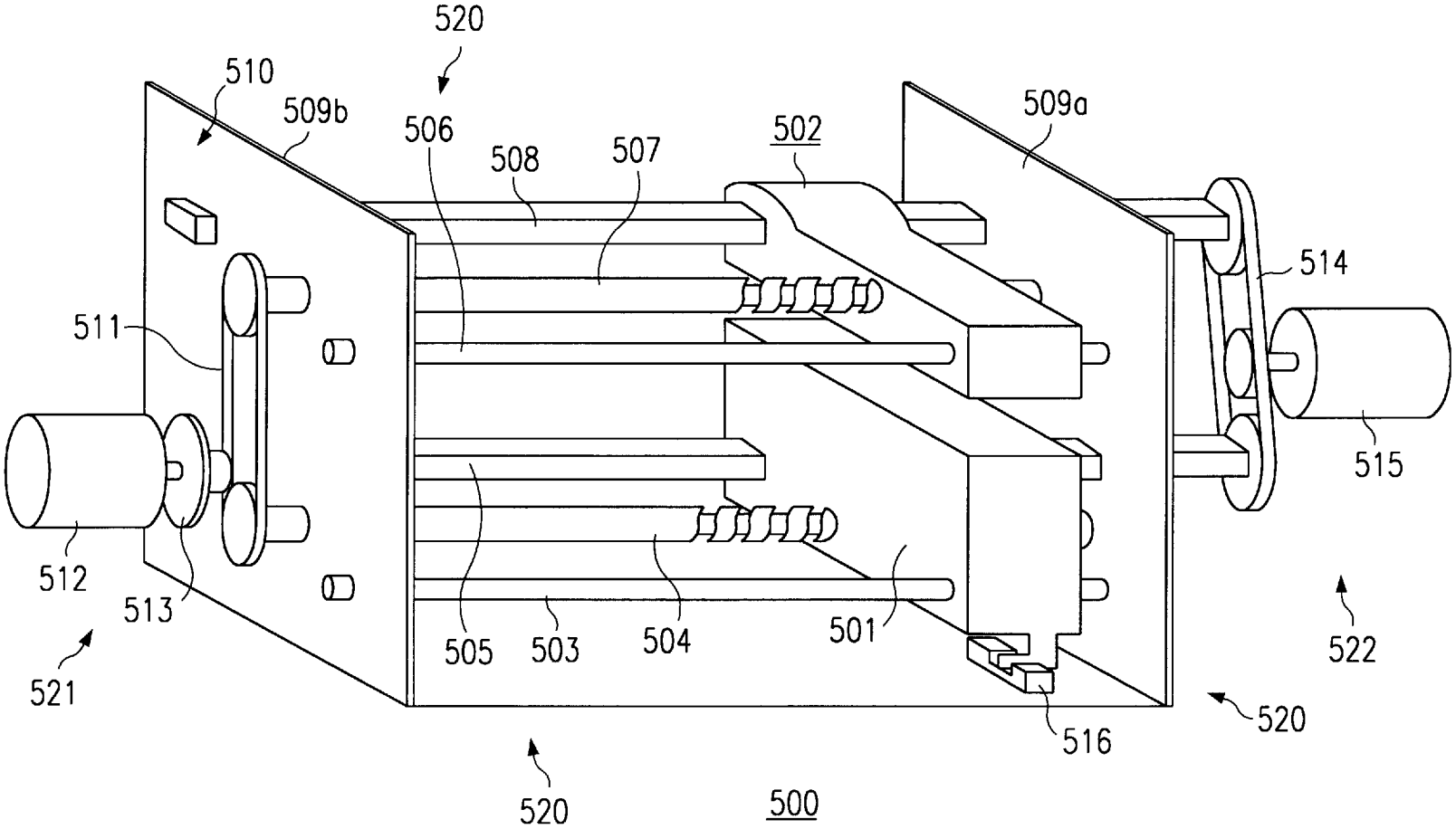
FIG. 5 is a perspective view illustrating the construction of the stapler shown in FIG. 2 above.

FIG. 4 is a structural diagram illustrating the stapler 500 together with the first and second sheet bundle conveying rollers 114–117 and FIG. 5 is a schematic perspective view illustrating the construction of the stapler 500.

The stapler 500 performs a stapling treatment at prescribed positions of a bundle of sheets nipped and conveyed by the first sheet bundle conveying rollers 114 and 115 which are positioned on the upstream side of the stapler 500 relative to the direction of conveyance of sheet. The stapler 500 comprises a head unit 501, an anvil unit 502, a supporting mechanism 520 for supporting these two units 501 and 502 such that they are freely moved in the sheet conveying perpendicular direction and freely rotated, a first drive mechanism 521 for moving the two units 501 and 502, and a second drive mechanism 522 for rotating the two units 501 and 502. In this stapler 500, members coupling or connecting the head unit 501 and the anvil unit 502 do not transverse the sheet conveying path.

Further, on the downstream side of the stapler 500, the second sheet bundle conveying rollers 116 and 117 for forwarding the bundle of sheets which have undergone the stapling treatment and the second sensor 118 to be used for fixing the stapling position for the bundle of sheets as will be specifically described herein below are installed.

The head unit 501 is adapted to sever one after another the staple needles accommodated integrally within a needle cartridge (not shown), bend the separated staple needle in the shape nearly resembling a letter U, and transfix the bundle of sheets with the bent staple needle. This unit 501 is provided with a sensor for detecting the presence or absence of staple needles in the needle cartridge.

The anvil unit 502 is adapted to bend inward the shanks of the staple needle which has penetrated through the bundle of sheets and, at the same time, expose itself to the shock of the needle driving motion produced by the head unit 501. This unit 502 comprises a receiving plate for inwardly bending the staple needle and a supporting plate for receiving the shock of the needle driving motion.

The supporting mechanism 520, as illustrated schematically in FIG. 5, comprises a frame 510 provided with a pair of lateral wall parts 509*a*, 509*b* and supporting shafts 503 and 506 extended along the sheet conveying perpendicular direction and supported by the frame 510. The distance between the lateral wall parts 509*a* and 509*b* in the frame 510 is set such that it at least surpasses the size of a sheet passable therethrough in the sheet conveying perpendicular direction. The supporting shafts 503 and 506 are each formed of a round bar and the supporting shaft 503 is inserted through the head unit 501 and the supporting shaft 506 is inserted through the anvil unit 502. The two units 501 and 502 are freely moved in the sheet conveying perpendicular direction along the supporting shafts 503 and 506 and are freely rotated respectively about the supporting shafts 503 and 506.

The first drive mechanism 521 comprises a spiral shaft 504 inserted through the head unit 501 and a spiral shaft 507 inserted through the anvil unit 502. The spiral shafts 504 and 507 are extended along the sheet conveying perpendicular direction and supported by the frame 510 mentioned above. In consequence of the rotation of the spiral shaft 504, the head unit 501 is moved in the sheet conveying perpendicular direction as guided by the supporting shaft 503. In consequence of the rotation of the spiral shaft 507, the anvil unit 502 is moved in the sheet conveying perpendicular direction as guided by the supporting shaft 506.

The second drive mechanism 522 comprises a drive shaft 505 inserted through the head unit 501 and a drive shaft 508 inserted through the anvil unit 502. The drive shafts 505 and 508 are extended along the sheet conveying perpendicular direction and supported by the frame 510 mentioned above. In consequence of the rotation of the drive shaft 505, the head unit 501 is rotated about the supporting shaft 503 as a center by virtue of the driving force transmitted thereto for the purpose of generating the needle driving motion. In consequence of the rotation of the drive shaft 508, the anvil unit 502 is rotated about the supporting shaft 506 as a center by virtue of the driving force transmitted thereto for the purpose of generating the needle bending motion. For the purpose of infallibly transmitting the driving force to the units 501 and 502, the drive shafts 505 and 508 each use a shaft possessed of a rectangular cross section incapable of generating slippage. When the drive shafts are each formed of a round bar, the slippage between the drive shafts and the units 501 and 502 may be precluded by means of a key or a key groove, for example.

The units 501 and 502 can be linearly moved independently and parallelly along the sheet conveying perpendicular direction with the aid of the plurality of shafts 503–505 and 506–508 which are inserted therethrough.

The head unit 501 and the anvil unit 502 are moved along the sheet conveying perpendicular direction by the rotation of the spiral shafts 504 and 507 which have the same phases. A timing belt 511 is suspended as passed around the spiral shafts 504 and 507. This belt 511 is connected to a drive motor 512. The drive motor 512 is formed of a DC motor and enabled by a pulse disc 513 to produce a controlled rotation. Owing to this construction, the units 501 and 502 can be severally moved in an equal amount. The first drive mechanism 521 is composed of the spiral shafts 504 and 507, the timing belt 511, the drive motor 521, etc.

A light-permeable sensor 516 is mounted on the frame 510 for the purpose of detecting the home positions of the units 501 and 502. By using the sensor 516 for detecting a douser provided on the head unit 501, the units 501 and 502 can be both moved to the respective home positions. The distances of motion of the units 501 and 502 are set on the basis of the home positions.

The head unit 501 and the anvil unit 502 are caused to produce the needle driving motion by the rotation of the drive shafts 505 and 508. A belt 514 is suspended as passed around the drive shafts 505 and 508. This belt 514 is connected to a drive motor 515. Owing to this construction, the units 501 and 502 are severally driven to produce a needle driving motion at positions arbitrarily selected in the sheet conveying perpendicular direction. The second drive mechanism 522 is composed of the drive shafts 505 and 508, the belt 514, the drive motor 515, etc.

[Description of operation]

The head unit 501 and the anvil unit 502 of the stapler 500 at first stand at rest at the home positions for intercepting the beam of light from the sensor 516. The sheets which have been discharged from the copying machine 10 are conveyed to the aftertreating tray 401 and piled and aligned therein. When as many sheets as suffice for one job are piled on the aftertreating tray 401, they are conveyed as a bundle in the direction of the stapler 500.

The first sheet bundle conveying rollers 114 and 115 as a sheet bundle transferring device for nipping and transporting the bundle of sheets to the stapler 500 can control the distance of motion of the bundle of sheets by the amounts of their rotation. By the first sheet bundle conveying rollers 114 and 115, the bundle of sheets are conveyed to and stopped at a position such that the stapling position arbitrarily selected on the bundle of sheets coincide with the needle driving position.

Thereafter, the moving drive motor 512 is set operating while relying on the pulse disc 513 to determine the amount of rotation and the spiral shafts 504 and 507 are rotationally driven through the medium of the belt 511. As a result, the two units 501 and 502 are severally moved over an equal distance in the direction of the stapling positions selected arbitrarily.

When the two units 501 and 502 are stopped at the selected stapling positions, the drive motor 515 is set operating and the drive shafts 505 and 508 are rotationally driven through the medium of the belt 514. As a result, the two units 501 and 502 are rotated to effect the needle driving work.

When the stapling treatment is performed at a plurality of points falling on a straight line along the sheet conveying perpendicular direction, the two units 501 and 502, after completing the needle driving work at the first point, are moved to the next needle driving point by the operation of the motor 512. Then, they perform the needle driving work by the operation of the motor 515. By repeating this procedure at the plurality of points mentioned above, the stapling treatment is wholly completed.

[Mechanism for conveyance of bundle of sheets]

With reference to FIG. 4, the first sheet bundle conveying rollers 114 and 115 formed of vertically paired rollers are disposed in the upstream part of the stapler 500 mentioned above and the second sheet bundle conveying rollers 116 and 117 formed of vertically paired rollers are disposed in the downstream part thereof. The distance between the nip position of the first sheet bundle conveying rollers 114 and 115 and the nip position of the second sheet bundle conveying rollers 116 and 117 is set at a size slightly smaller than the smallest of the sizes of sheets to be conveyed.

The first sheet bundle conveying rollers 114 and 115 are freely converged or diverged by the operation of the first DC motor. The rollers 114 and 115 are rotationally driven by the stepping motor and the amount of conveyance of the bundle of sheet is controlled by controlling the revolution numbers of the stepping motor. The second sheet bundle conveying rollers 116 and 117 are similarly constructed such that they are freely converged or diverged by the operation of the second DC motor, independently of the first sheet bundle conveying rollers 114 and 115. The rollers 116 and 117 are rotationally driven by the same stepping motor as is used for driving the rollers 114 and 115 and are utilized for controlling the amount of conveyance of the bundle of sheets. The rollers 114–117 are severally formed of rollers of low hardness, identical in material and similar in shape. The rollers 116 and 117 have a smaller diameter than the rollers 114 and 115.

Figure 6A:
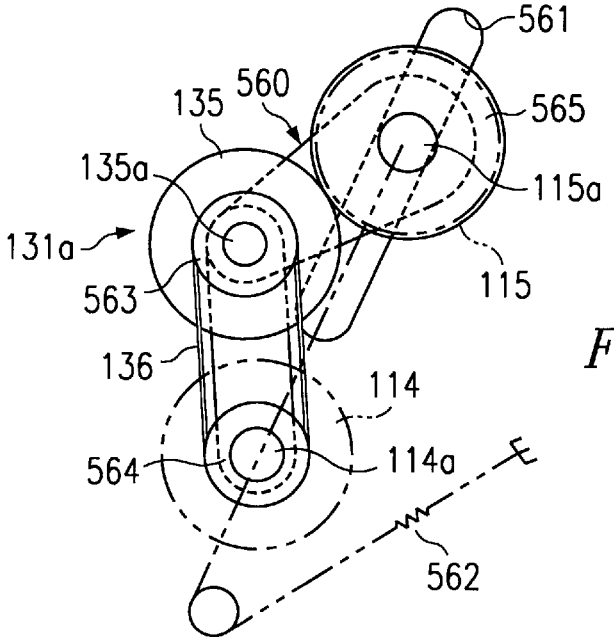
FIGS. 6*a*–6*c* are diagrams illustrating the construction of first sheet bundle conveying rollers shown in FIG. 5 above.

The lower roller 114 and the upper roller 115 of the first sheet bundle conveying rollers 114 and 115 are connected to each other through the medium of a drive transmitting mechanism 131*a* which is possessed of at least one idle gear 135 as illustrated in FIG. 6A. The lower roller 114 is disposed such that the surface thereof protrudes from the surface of the pile of sheets on the aftertreating tray 401 as described above. The drive transmitting mechanism 131*a* comprises a link mechanism 560 interconnecting bearings 135*a,* 114*a,* and 115*a* of the idle gear 135, the lower roller 114 and the upper roller 115. This link mechanism 560 regulates the interaxial distance between the idle gear 135 and the lower roller 114 and the interaxial distance between the idle gear 135 and the upper roller 115. An oblong hole 561 is formed in a casing (not shown) rotatably supporting the bearing 114*a* of the lower roller 114. The bearing 115*a* of the upper roller 115 is slidably inserted through this oblong hole 561. When the link mechanism 560 is actuated by the operation of the first DC motor, the upper roller 115 is moved between the position of divergence (FIG. 6B) and the position of convergence (FIG. 6C) with the bearing 115*a* guided along the oblong hole 561.

To the bearing 115*a* of the upper roller 115 is connected one end of a spring 562 which imparts pressing force. The length of the oblong hole 561 is set at a size such that the bearing 115*a* avoids contacting the end part of the oblong hole 561 while the upper roller 115 remains in pressure contact with the lower roller 114. The prescribed pressing force of the spring 561 is exclusively imparted to the upper roller 115.

A belt 136 is suspended as passed around pulleys 563 and 564 which are mounted on the bearings 135*a* and 114*a* respectively of the idle gear 135 and the lower roller 114. The idle gear 135 is meshed with a gear 565 mounted on the bearing 115*a* of the upper roller 115. The rotational driving force of the stepping motor is transmitted to the lower roller 114. Owing to the construction mentioned above, the transmission of the rotational driving force to the upper roller 115 is realized in spite of the absence of pressure contact between the upper and lower rollers 114 and 115.

Figure 6B:
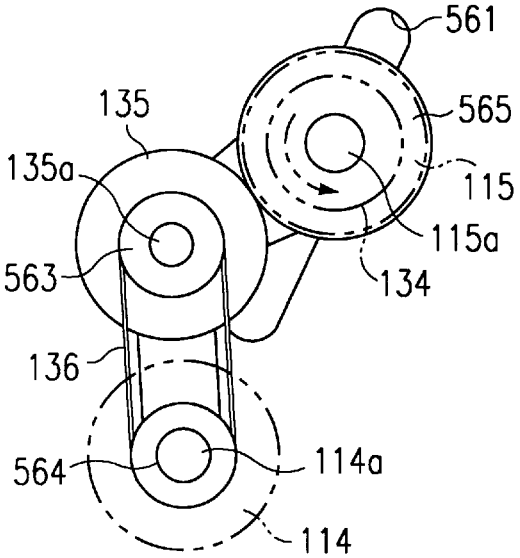
Figure 6C:
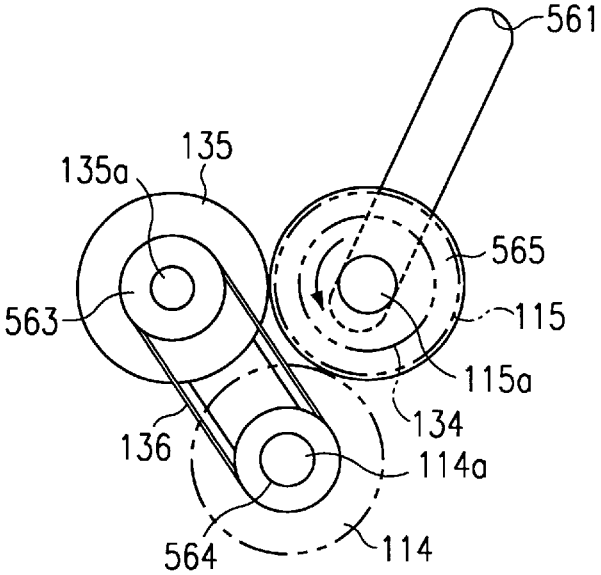

On the bearing 115*a* of the upper roller 115, at least one one-way clutch 134 which allows rotation of itself exclusively in the direction indicated by an arrow is mounted as illustrated in FIG. 6B and FIG. 6C. This one-way clutch 134 serves the purpose of preventing the upper roller 115 from rotation when the upper roller 115 is lowered from the position of divergence to the position of convergence by the operation of the link mechanism 560.

The second sheet bundle conveying rollers 116 and 117 are similarly constructed, though omitted from the illustration.

A first sensor 137 for detecting the edge of the incoming bundle of sheets is disposed near the downstream of the first sheet bundle conveying rollers 114 and 115 and a second sensor 118 is disposed similarly near the downstream of the second sheet bundle conveying rollers 116 and 117 as illustrated in FIG. 4. The sensors 118 and 137 are installed at such positions as are separated by respectively prescribed distances from the staple driving position.

Incidentally, the sheet conveying path at least between the first sheet bundle conveying rollers 114 and 115 and the second sensor 118 is formed of a straight conveying guide.

The leading end part of the bundle of sheets is aligned by the leading end stopper 409 during the temporary accumulation of sheets. Since the convergence of the first sheet bundle conveying rollers 114 and 115 is started in the situation just mentioned, the leading end part of the bundle of sheets is nipped in the aligned state by the first sheet bundle conveying rollers 114 and 115.

Since the sheet conveying path from the first sheet bundle conveying rollers 114 and 115 to the stapling position has a straight shape, the leading end part of the bundle of sheets keeps the aligned state thereof intact even when the bundle of sheets is nipped and conveyed by the first sheet bundle conveying rollers 114 and 115 to the stapling position.

If the sheet conveying path in the downstream of the first sheet bundle conveying rollers 114 and 115 in the direction of conveyance is bent in the shape of an arc, the leading end part of the bundle of sheets will be slanted relative to the guide plate because the bundle of sheets is elongated along the guide plate of a small radius and shortened along the guide plate of a large radius. If the staple needle is driven perpendicularly to the guide plate while the bundle of sheets is in the state mentioned above, the bundle of sheets will be inevitably bound obliquely.

When the stapler 500 performs the stapling treatment on the bundle of sheets which is nipped by the first sheet bundle conveying rollers 114 and 115, therefore, the sheet conveying path from the first sheet bundle conveying rollers 114 and 115 to the stapling position must be in a straight shape.

The present embodiment, as described specifically hereinbelow, is constructed such that the bundle of sheets nipped and conveyed by the first sheet bundle conveying rollers 114 and 115 is transferred to the second sheet bundle conveying rollers 116 and 117 and consequently is freed of the control by the first sheet bundle conveying rollers 114 and 115 and the stapler 500 is then allowed to perform a stapling treatment on the bundle of sheets presently nipped and conveyed exclusively by the second sheet bundle conveying rollers 116 and 117. The leading end part of the bundle of sheets, therefore, must remain in the aligned state until the bundle of sheets nipped and conveyed by the first sheet bundle conveying rollers 114 and 115 is newly nipped by the second sheet bundle conveying rollers 116 and 117. The sheet conveying path from the first sheet bundle conveying rollers 114 and 115 to the second sensor 118 at which the second sheet bundle conveying rollers 116 and 117 starts nipping the bundle of sheets, therefore, must be in a straight shape.

The conveying path in the downstream from the second sensor 118 does not need to be in a straight shape but may be bent in the shape of an arc, for example, because the second sheet bundle conveying rollers 116 and 117 nip the bundle of sheets in the downstream from the stapling position as described above. The finisher as a whole, therefore, can be prevented from enlarging the size of itself.

[Control of stapling position]

When the staple mode to be adopted is selected, the sheets are accumulated on the aftertreating tray 401. At this time, the first sheet bundle conveying rollers 114 and 115 are kept in a mutually separated state. When the temporary accumulation of sheets is completed, the first sheet bundle conveying rollers 114 and 115 are shifted to a state of convergence to nip the bundle of sheets and the leading end stopper 409 retreats outside from the boundary of the sheet bundle conveying path. Then, the bundle of sheets is conveyed by rotating the first sheet bundle conveying rollers 114 and 115 and the stapling position is located along the direction of conveyance of sheet. The present embodiment contemplates three staple modes, i.e. (1) the leading end bind which binds the leading end part of the bundle of sheets along the direction of conveyance of a bundle of sheets, (2) the center bind which binds the central part of the bundle of sheets along the direction of conveyance of a bundle of sheets, and (3) the trailing end bind which binds the trailing end part of the bundle of sheets along the direction of conveyance of a bundle of sheets. The operation of the location mentioned above varies among these modes. The operation of the location for each of the modes will be described below.

(1) Leading end bind

FIG. 7–FIG. 12 are explanatory diagrams to aid in the description of the operation of leading end bind.

Figure 7:
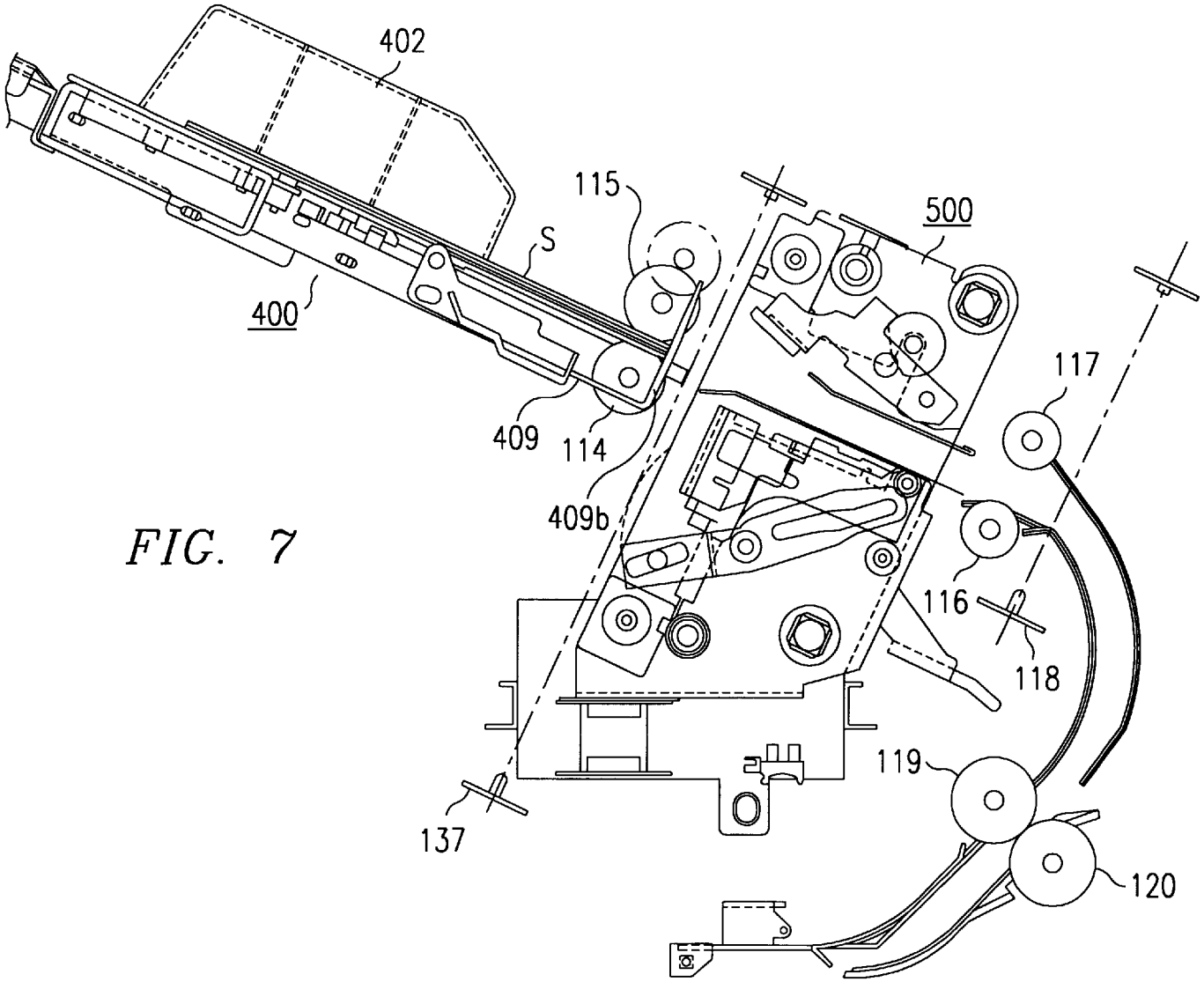
FIG. 7 is a diagram to aid in the description of the leading end binding operation effected by the stapler mentioned above.
Figure 8:
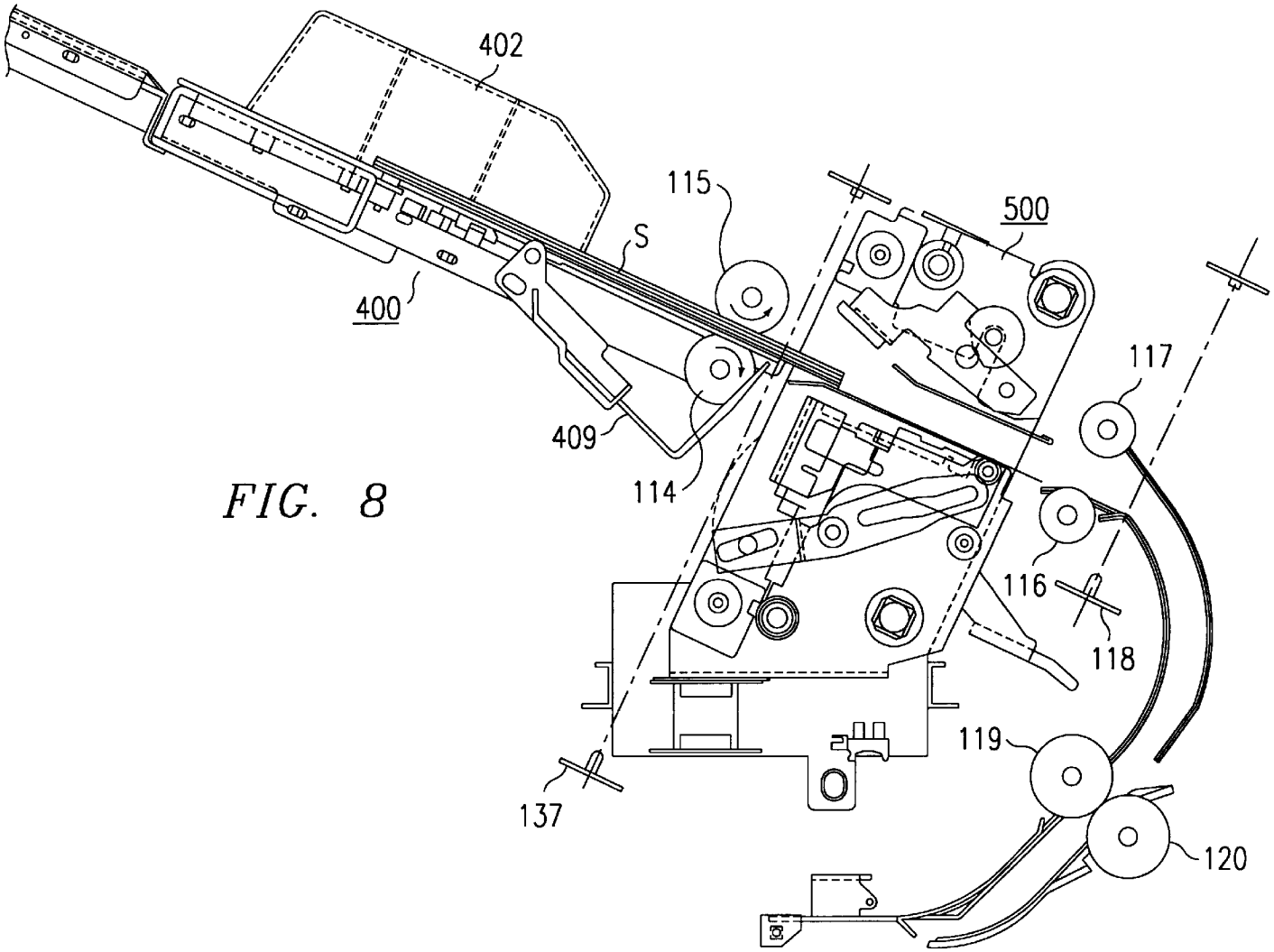
FIG. 8 is a diagram continuing from FIG. 7 above to aid in the description of the leading end binding operation effected by the stapler.

The leading end part of the bundle of sheets S has already undergone the FD alignment performed during the temporary accumulation of sheets, with the blocking part 409*b* of the leading end stopper 409 used as a regulating face (FIG. 7 refers). In the mode of leading end bind, therefore, it suffices for the location of the stapling position to convey the bundle of sheets S in a prescribed amount without reference to the size of sheet. To be specific, the bundle of sheets S is only required to be conveyed by the first sheet bundle conveying rollers 114 and 115 in the amount resulting from adding the distance from the end face of the leading end part of the bundle of sheets S to the expected stapling position (normally about 10 mm) to the distance from the blocking part 409*b* of the leading end stopper 409 to the stapler 500 (FIG. 8 refers).

Figure 9:
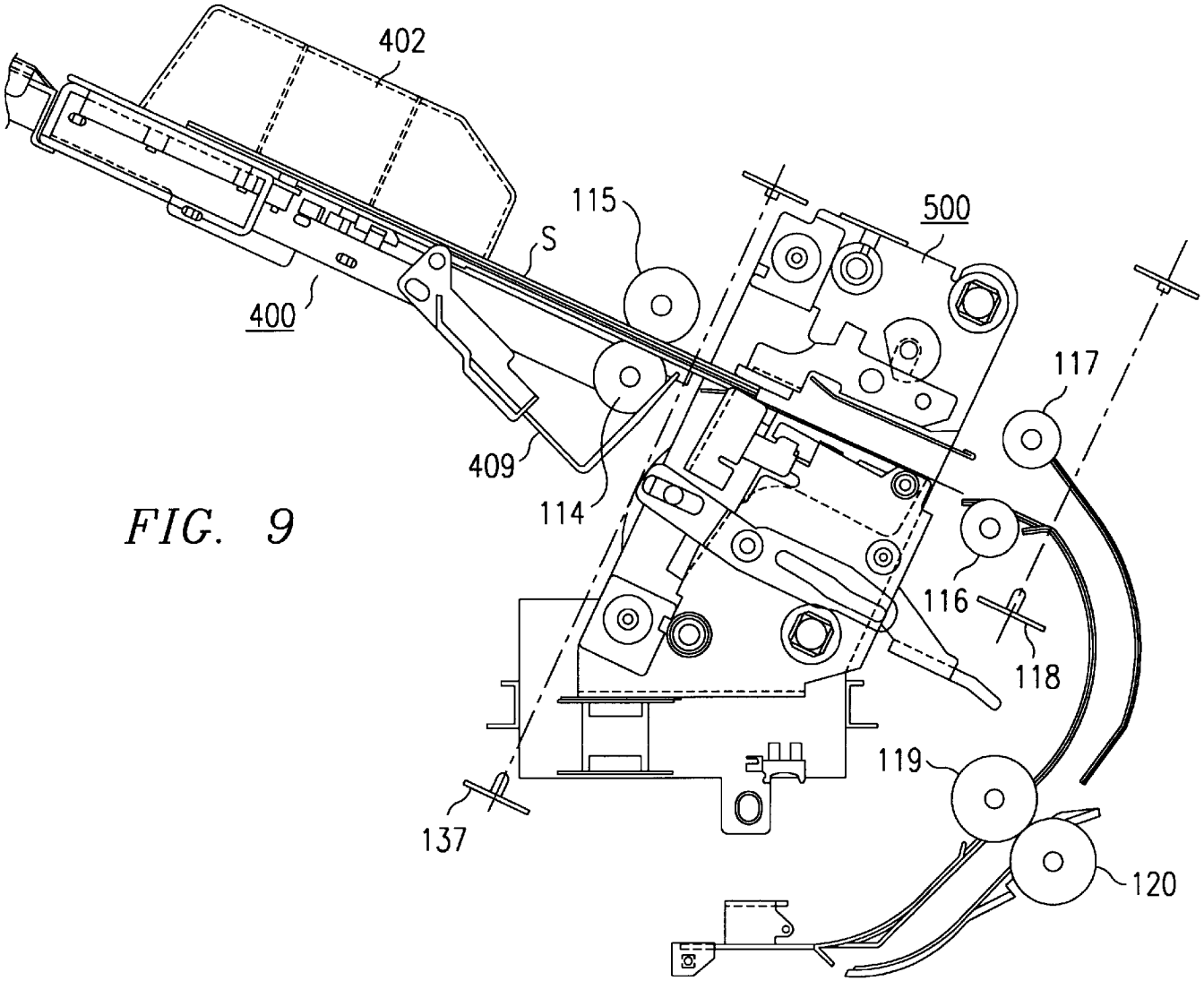
FIG. 9 is a diagram continuing from FIG. 8 above to aid in the description of the leading end binding operation effected by the stapler.

After the bundle of sheets S has been conveyed in the prescribed amount mentioned above, the rollers 114 and 115 are stopped and the stapler 500 is actuated to perform a stapling treatment on the bundle of sheets S (FIG. 9 refers).

Figure 10:
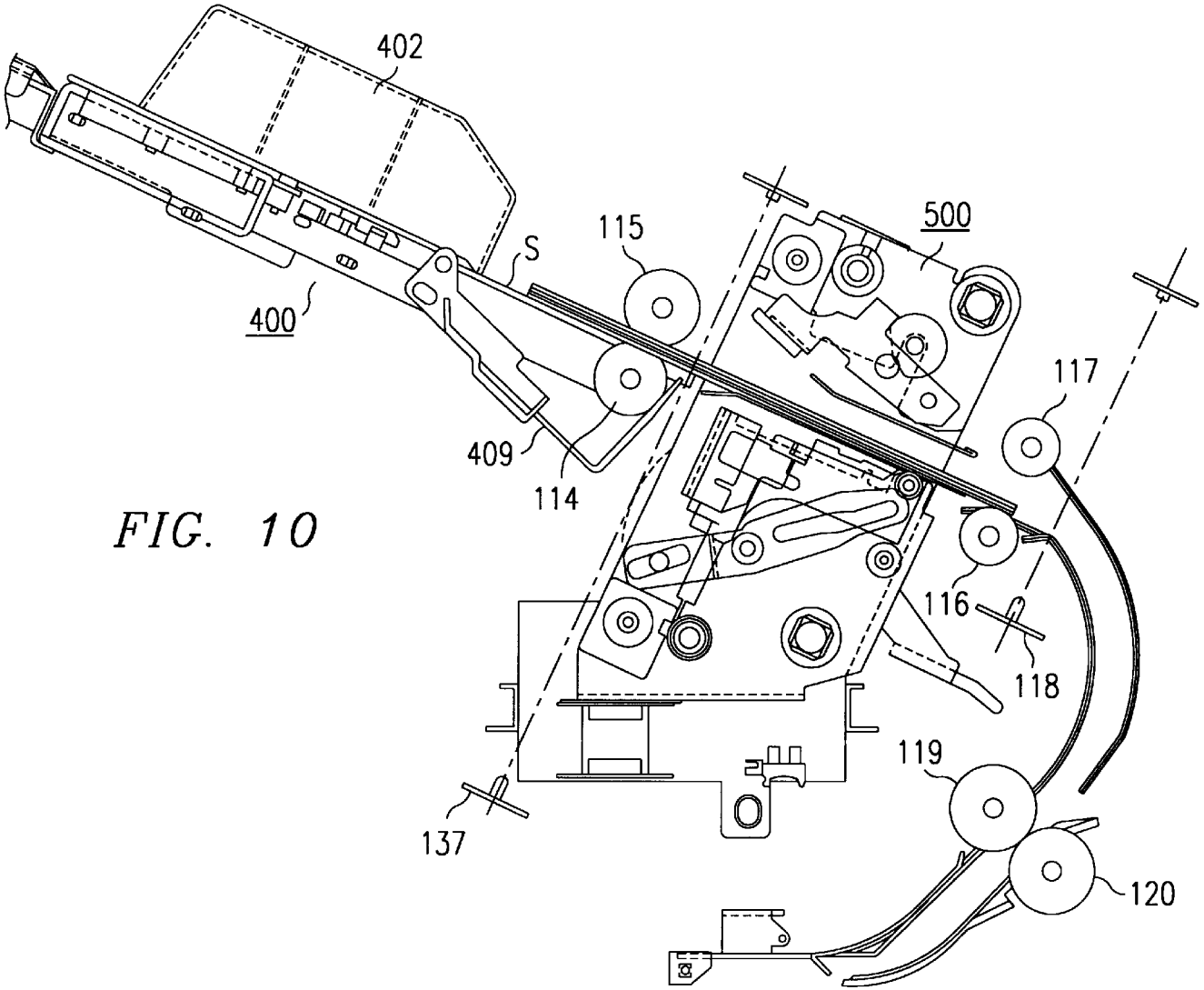
FIG. 10 is a diagram continuing from FIG. 9 above to aid in the description of the leading end binding operation effected by the stapler.

The conveyance of the bundle of sheets S is resumed after the completion of the stapling treatment. The conveyance of the bundle of sheets S is stopped when the leading end part thereof completely reaches the second sheet bundle conveying rollers 116 and 117. At this time, the second sheet bundle conveying rollers 116 and 117 are still in a mutually separated state (FIG. 10 refers).

Figure 11:
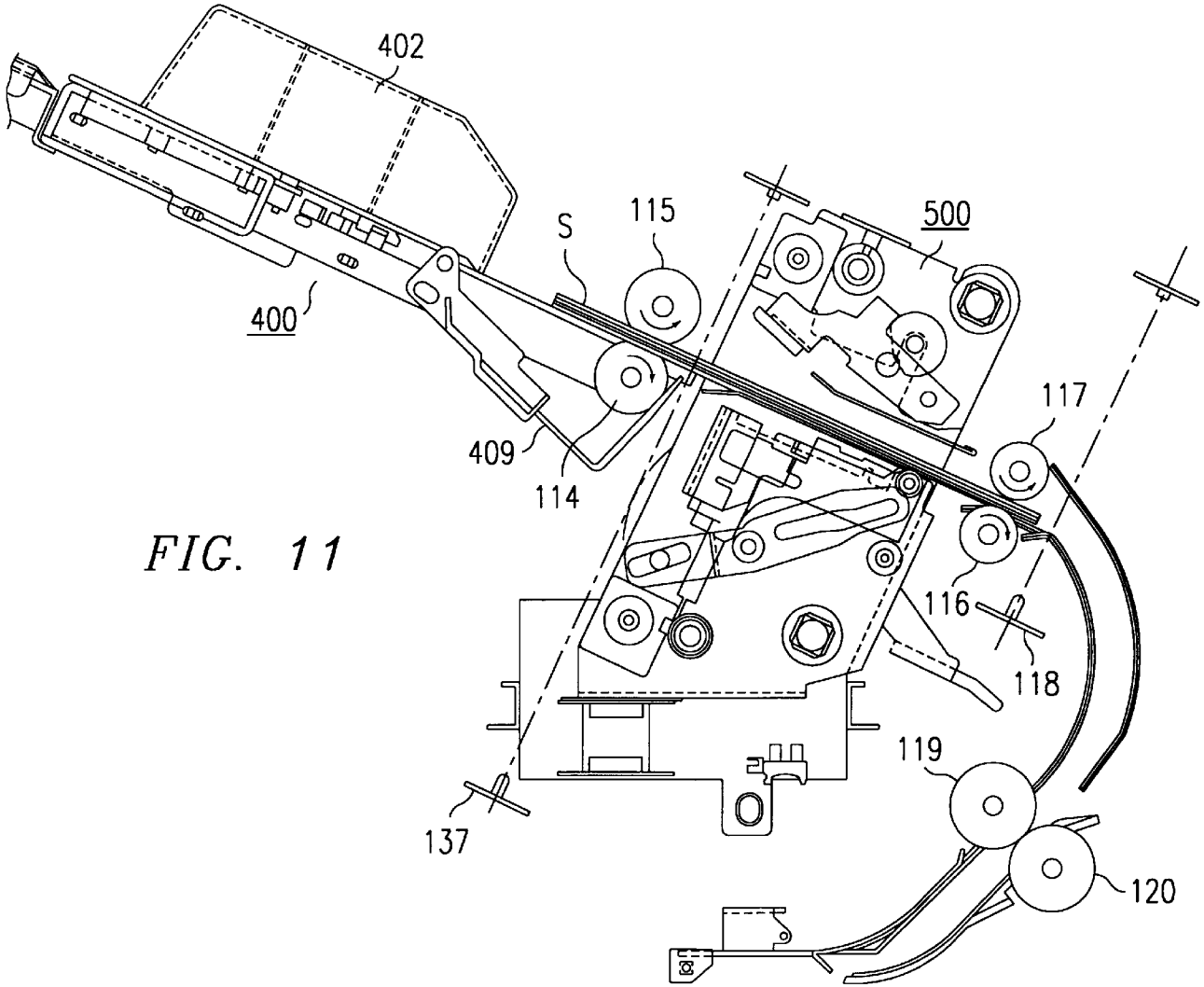
FIG. 11 is a diagram continuing from FIG. 10 above to aid in the description of the leading end binding operation effected by the stapler.

After the conveyance of the bundle of sheets S has ceased, the second sheet bundle conveying rollers 116 and 117 are shifted to a state of convergence to nip the leading end part of the bundle of sheets S. Then, the second sheet bundle conveying rollers 116 and 117 are set rotating to start the conveyance of the bundle of sheets S again (FIG. 11 refers).

Figure 12:
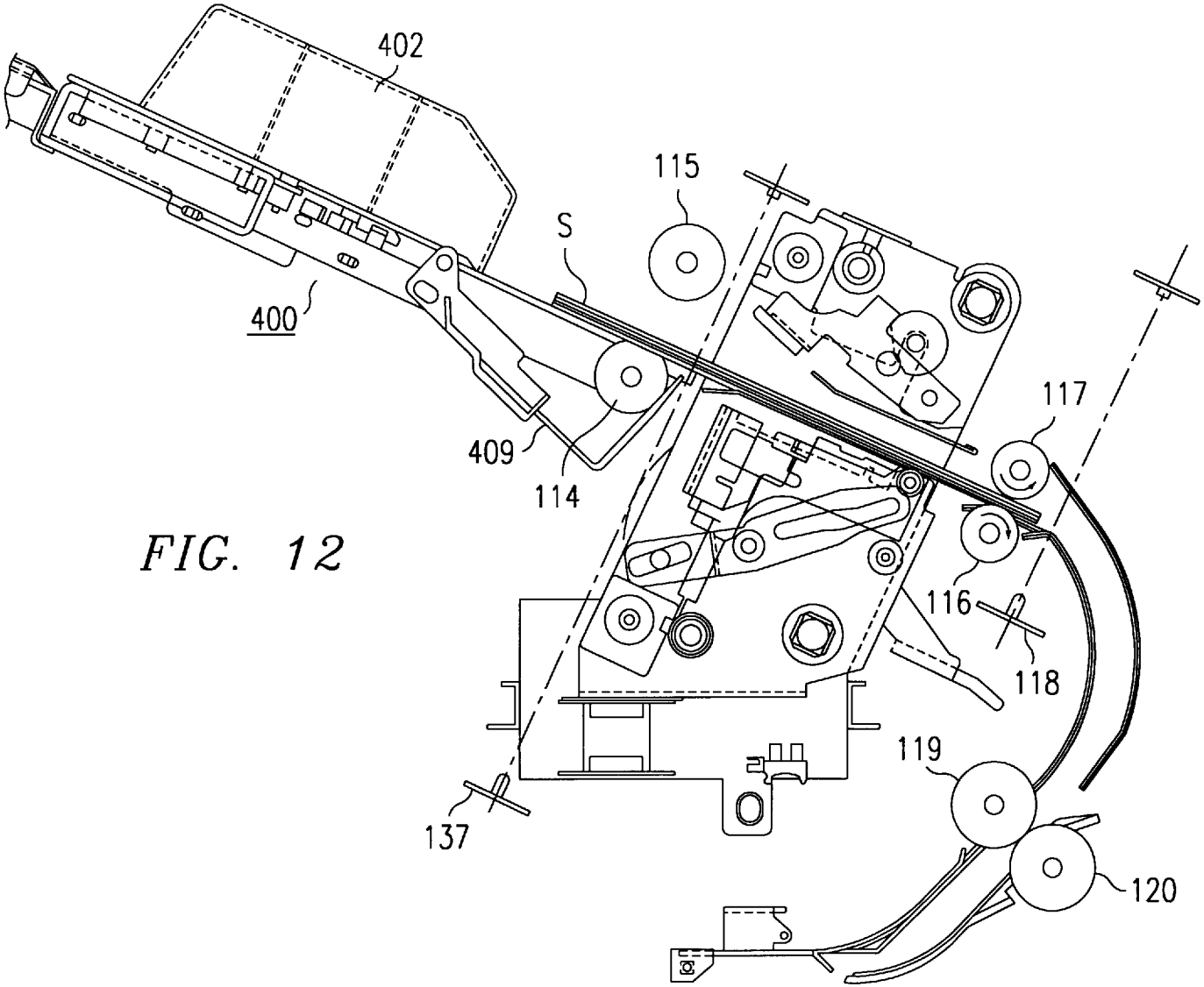
FIG. 12 is a diagram continuing from FIG. 11 above to aid in the description of the leading end binding operation effected by the stapler.

By driving the first DC motor while continuing the conveyance of the bundle of sheets S, the first sheet bundle conveying rollers 114 and 115 are exclusively shifted to a mutually separated state (FIG. 12 refers). The bundle of sheets S is subsequently nipped by the second sheet bundle conveying rollers 116 and 117 and conveyed in the direction of the accumulating tray part 600.

The first and second sheet bundle conveying rollers 114–117 are rotationally driven by the stepping motor. The amount of conveyance of the bundle of sheets S, therefore, is controlled by regulating the number of pulses of the stepping motor. The stepping motor and the drive system which drive the first and second sheet bundle conveying rollers 114–117 will be described herein below.

(2) Center bind

FIG. 13–FIG. 16 are explanatory diagrams to aid in the description of the operation of the center bind.

In the mode of center bind, the stapling treatment is performed in the central part of the bundle of sheets S along the direction of conveyance of sheet. Only naturally, therefore, the amount of conveyance of the bundle of sheets S for the sake of the stapling treatment varies with the size of sheet to be used. This amount of conveyance is long as compared with that involved in the mode of leading end bind.

Since the conveyance of the bundle of sheets S is effected by the use of the stepping motor, it is theoretically possible to attain by simply managing the number of pulses the control of the amount of conveyance in spite of a possible addition to the distance of conveyance. Since the diameters of the sheet bundle conveying rollers 114–117 and the widths of the nips thereof cannot be thoroughly freed from dimensional dispersions, however, the error which creeps in the actual amount of conveyance grows in proportion as the distance of conveyance elongates. To diminish this error, therefore, the conveyance of the bundle of sheets S in the mode of center bind is effected as follows.

Figure 13:
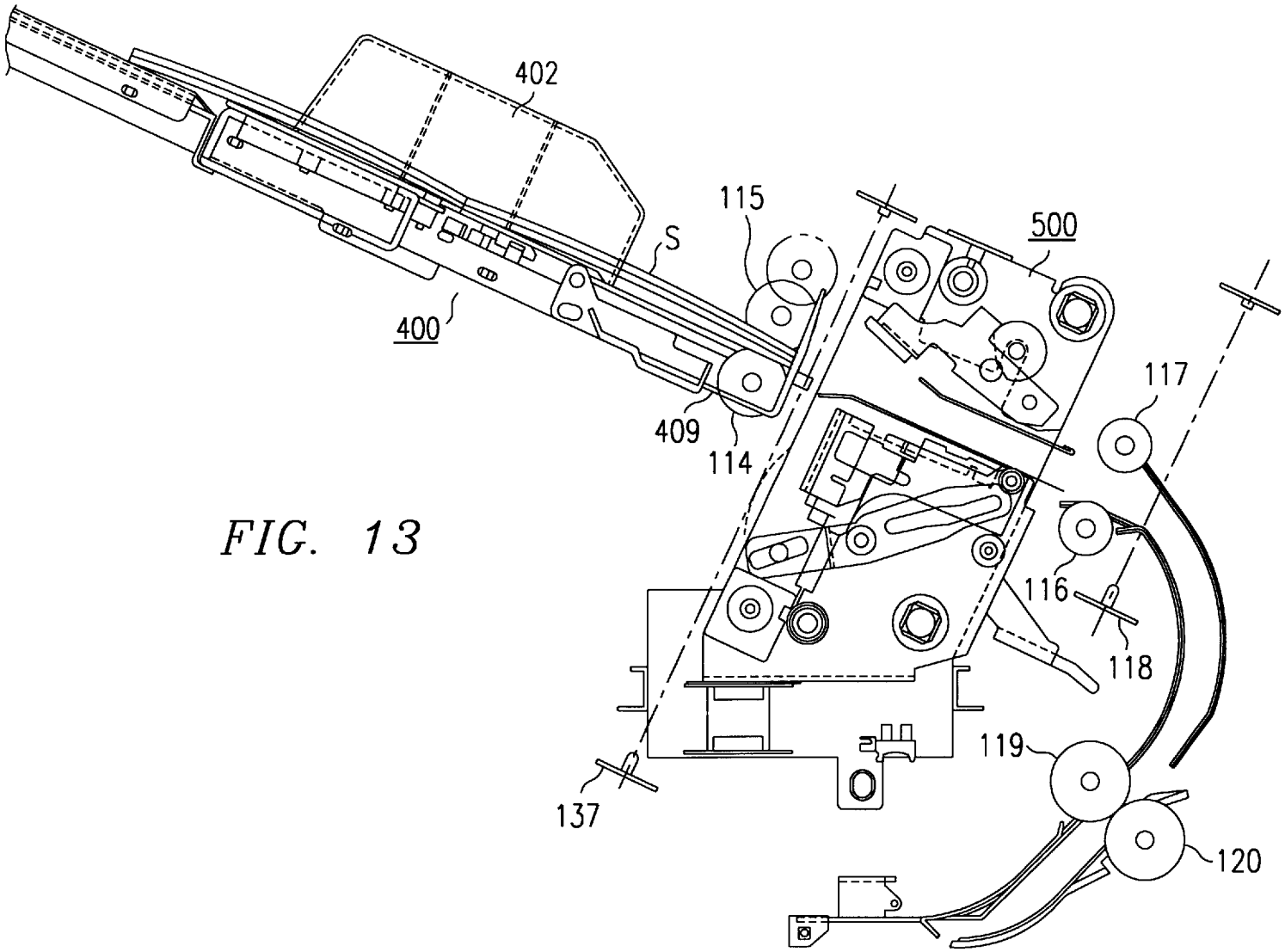
FIG. 13 is a diagram to aid in the description of the center binding operation effected by the stapler mentioned above.
Figure 14:
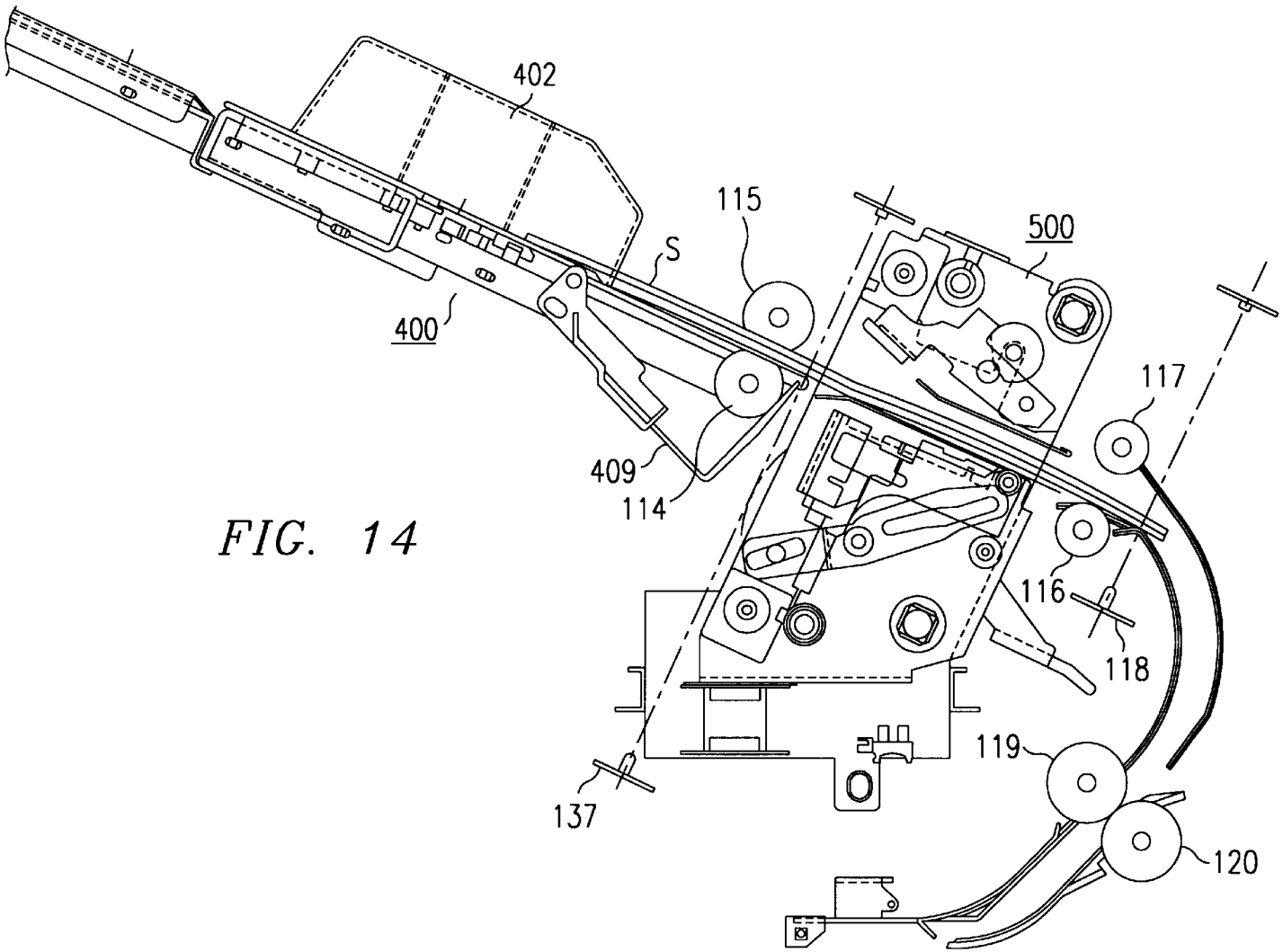
FIG. 14 is a diagram continuing from FIG. 13 above to aid in the center binding operation effected by the stapler.
Figure 15:
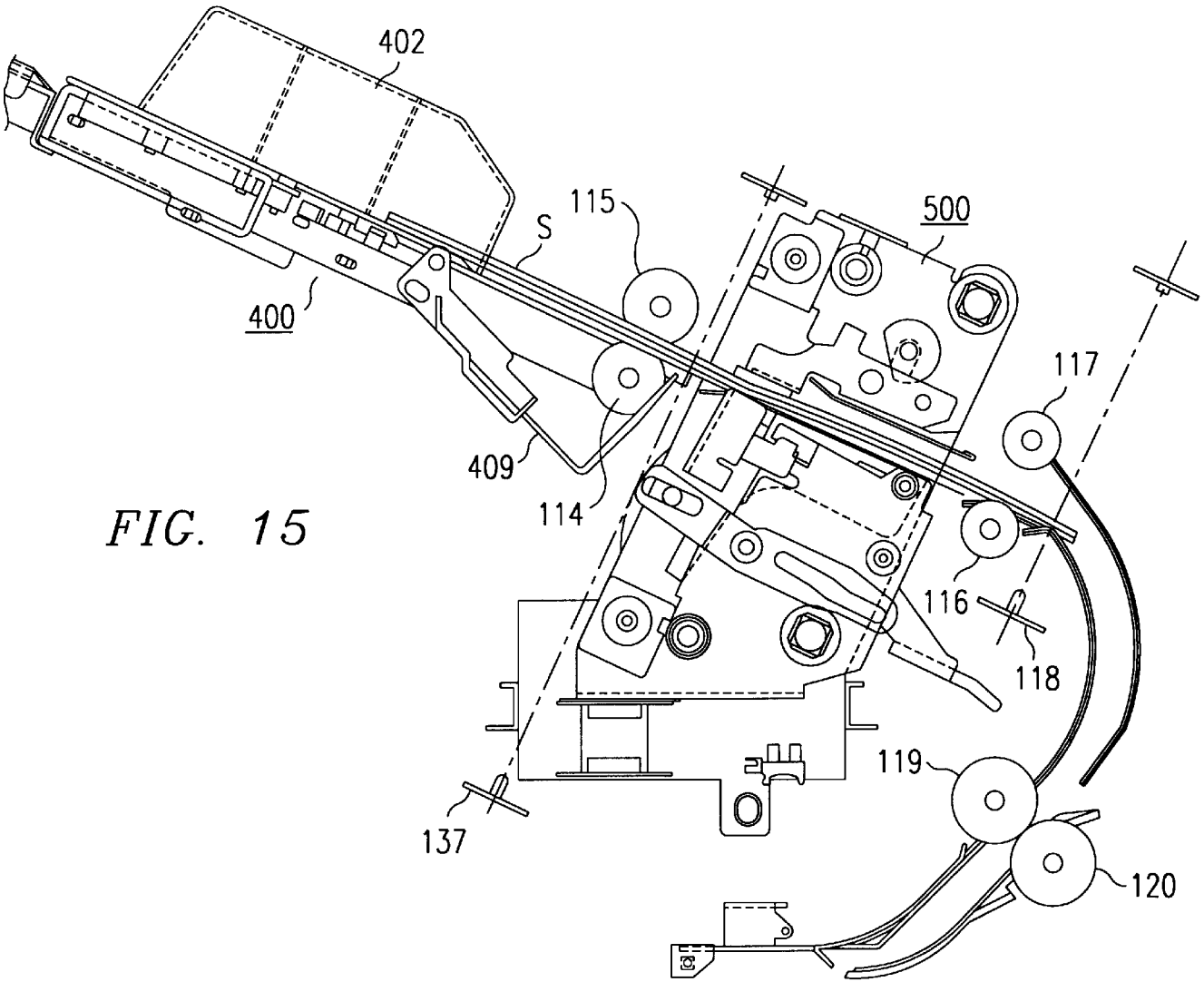
FIG. 15 is a diagram continuing from FIG. 14 above to aid in the center binding operation effected by the stapler.

First, the bundle of sheets S is nipped and conveyed by the first sheet bundle conveying rollers 114 and 115. When the second sensor 118 disposed in the downstream of the second sheet bundle conveying roller 116 and 117 detects the leading end of the bundle of sheets S, the conveyance is further made in a prescribed amount proper for the sheet size and then the conveyance of the bundle of sheets S is stopped (FIG. 13 and FIG. 14 refer). After the conveyance of the bundle of sheets S has been stopped, the stapling treatment is performed on the bundle of sheets S (FIG. 15 refers).

Figure 16:
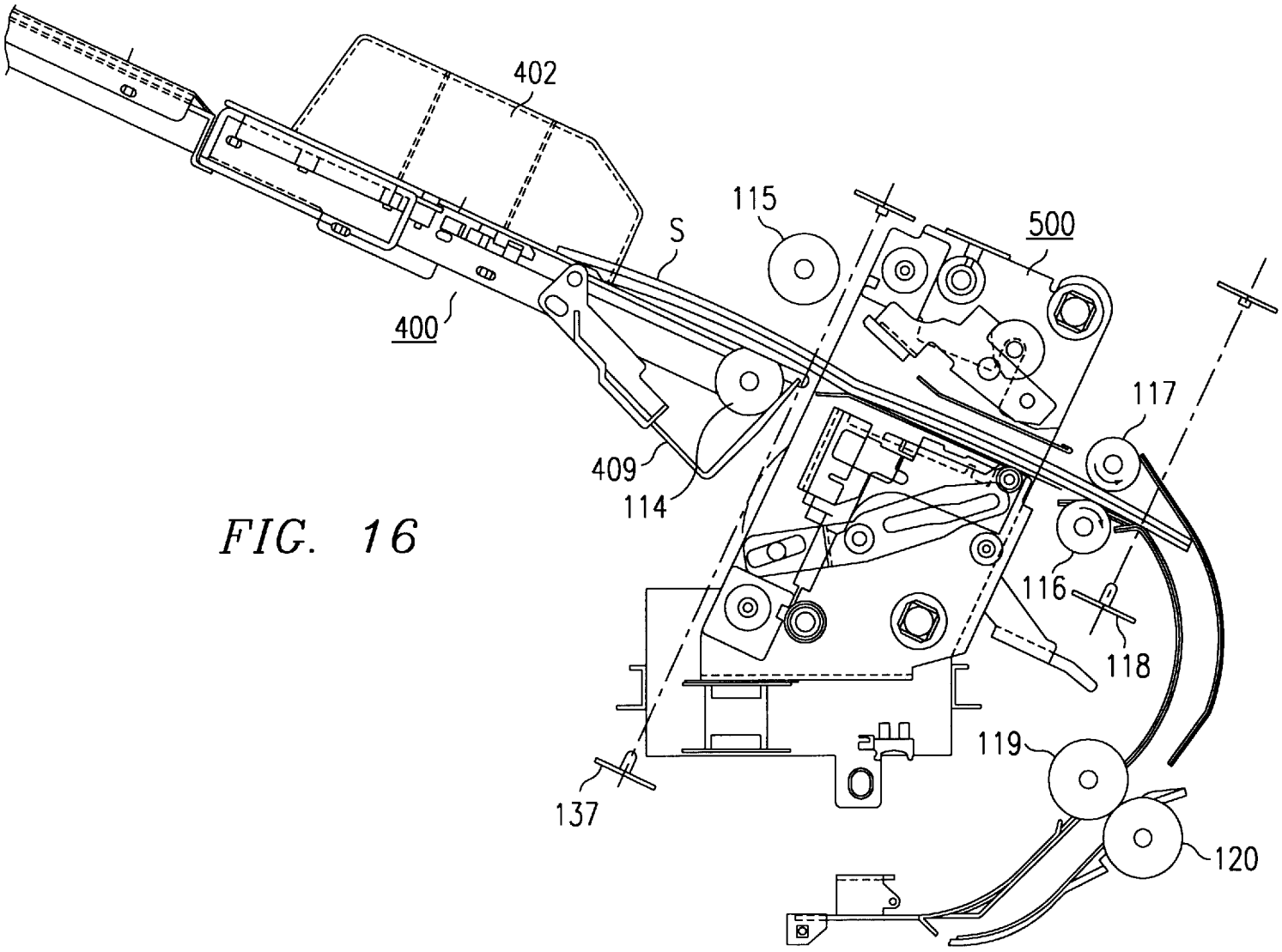
FIG. 16 is a diagram continuing from FIG. 15 above to aid in the center binding operation effected by the stapler.

At this time, since the leading end part of the bundle of sheets S has completely reached the second sheet bundle conveying rollers 116 and 117, the bundle of sheets S is nipped by the second sheet bundle conveying rollers 116 and 117. Then, the second sheet bundle conveying rollers 116 and 117 are set rotating to resume the conveyance of the bundle of sheets S and meanwhile the first DC motor is set driving to shift the first sheet bundle conveying rollers 114 and 115 alone to a mutually separated state while continuing the conveyance of the bundle of sheets S (FIG. 16 refers). Thereafter, the bundle of sheets S is nipped by the second sheet bundle conveying rollers 116 and 117 and conveyed in the direction of the accumulating tray part 600.

The center bind mode is effectively utilized exclusively for sheets which have a length of not less than twice the length of the smallest of the sizes of sheets to be conveyed.

Incidentally, for the purpose of shortening the total time required for the conveyance of a bundle of sheets and heightening the productivity concerned in the case of the leading end bind and the center bind, the bundle of sheets S is again nipped and conveyed by both the first sheet bundle conveying rollers 114 and 115 located in the upstream of the stapler 500 and the second sheet bundle conveying rollers 116 and 117 located in the downstream thereof before the first sheet bundle conveying rollers 114 and 115 are subjected to an operation for divergence and the divergence of the first sheet bundle conveying rollers 114 and 115 is effected during the course of the conveyance just mentioned.

(3) Trailing end bind

FIG. 17–FIG. 20 are explanatory diagrams to aid in the description of the operation of trailing end bind.

Figure 17:
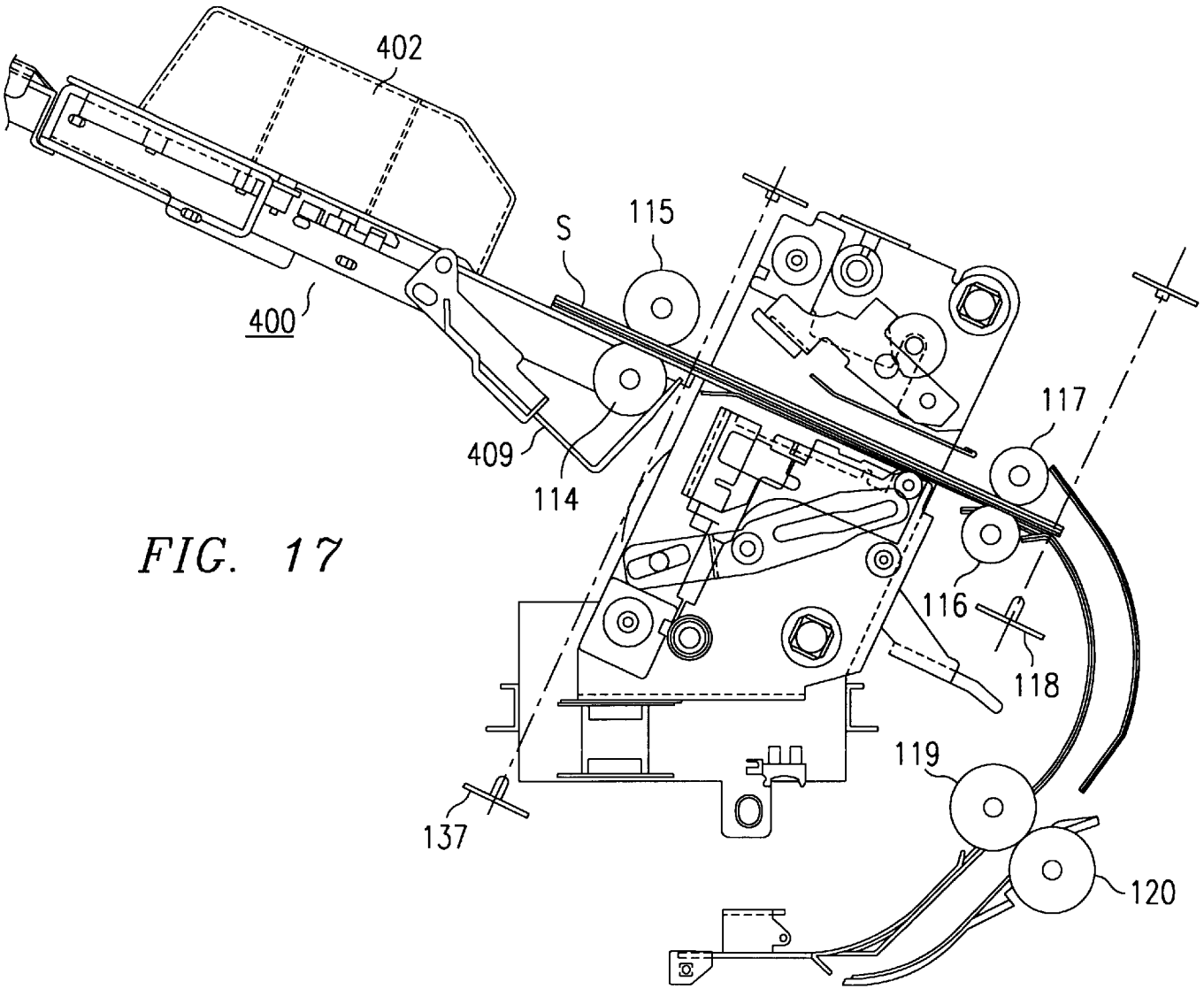
FIG. 17 is a diagram to aid in the description of the trailing end binding operation effected by the stapler mentioned above.

In the mode of trailing end bind, first the bundle of sheets S is nipped and conveyed by the first sheet bundle conveying rollers 114 and 115. When the leading end part of the bundle of sheets S completely reaches the second sheet bundle conveying rollers 116 and 117, this conveyance is stopped and the bundle of sheets S is nipped by the second sheet bundle conveying rollers 116 and 117 (FIG. 17 refers).

Figure 18:
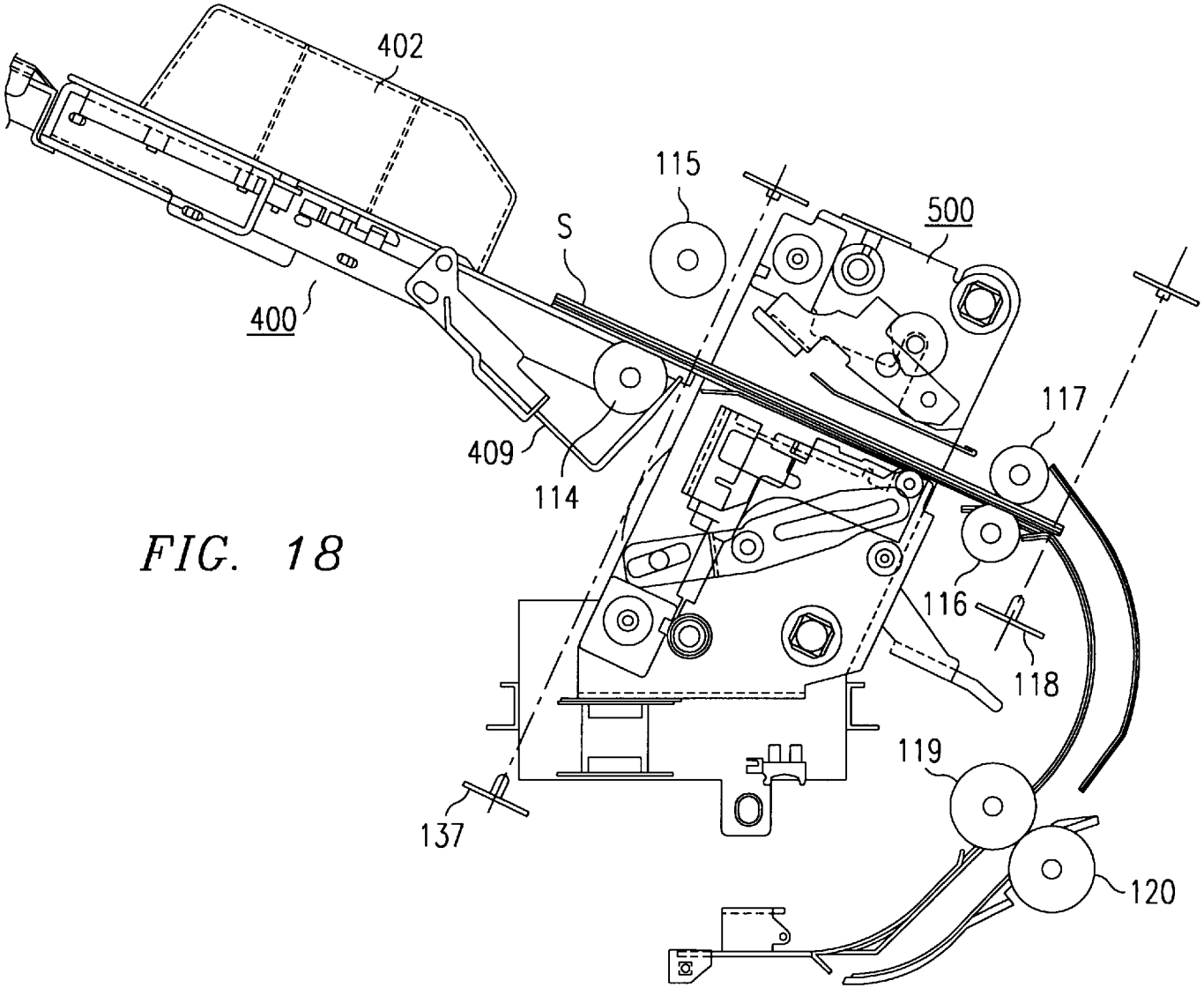
FIG. 18 is a diagram continuing from FIG. 17 to aid in the description of the trailing end binding operation effected by the stapler mentioned above.

When this nipping by the second sheet bundle conveying rollers 116 and 117 is completed, the first DC motor is set driving to shift the first sheet bundle conveying rollers 114 and 115 to a mutually separated state (FIG. 18 refers). By this time, the conveyance of the bundle of sheets S has been stopped. The reason for this stop of the conveyance is as follows. Unlike in the leading end bind or the center bind described above, the stapling treatment has not yet been performed by the time that the bundle of sheets S is nipped by the second sheet bundle conveying rollers 116 and 117. If the conveyance of the bundle of sheets S is resumed before the first sheet bundle conveying rollers 114 and 115 are completely separated, therefore, the individual sheets in the bundle of sheets S will be deviated by a disagreement in the timing of starting or a very slight disagreement in the speed of conveyance between the first sheet bundle conveying rollers 114 and 115 and the second sheet bundle conveying rollers 116 and 117. The stop of the conveyance serves the purpose of precluding such a deviation in the bundle of sheets S as mentioned above.

Figure 19:
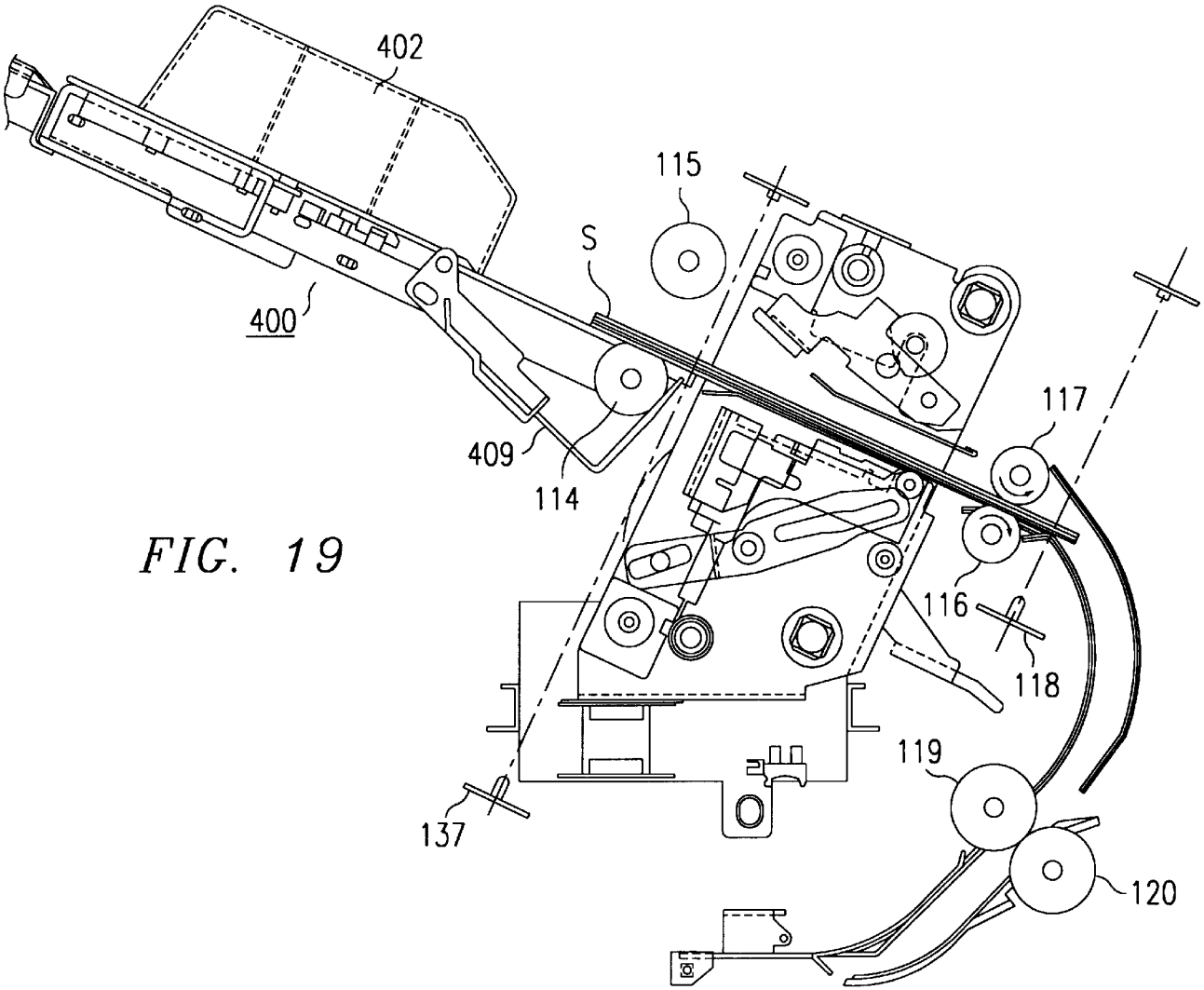
FIG. 19 is a diagram continuing from FIG. 18 to aid in the description of the trailing end binding operation effected by the stapler.

After this operation for mutually separating the first sheet bundle conveying rollers 114 and 115 is completed, the second sheet bundle conveying rollers 116 and 117 is set rotating to resume the conveyance of the bundle of sheets S (FIG. 19 refers).

Figure 20:
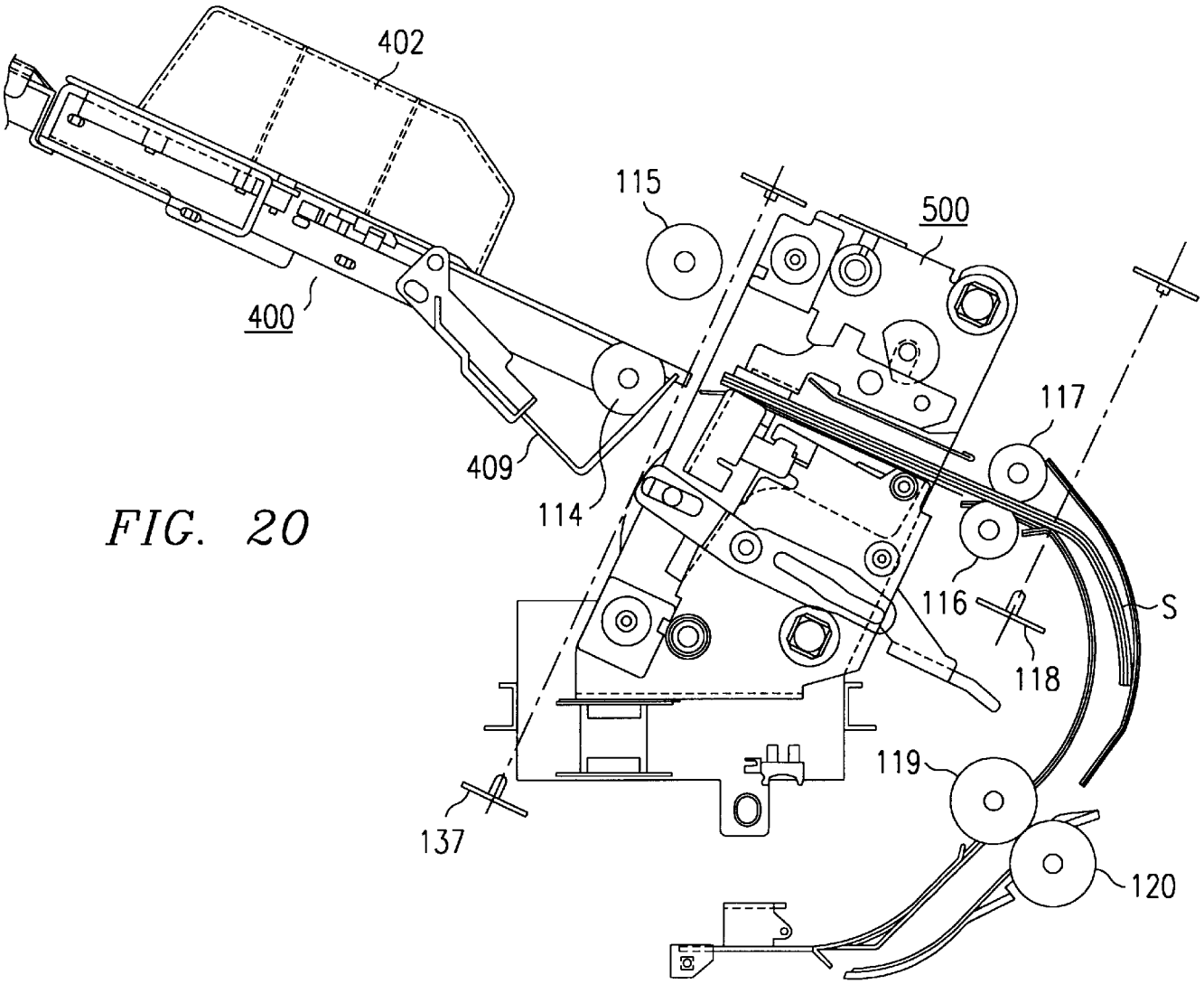
FIG. 20 is a diagram continuing from FIG. 19 to aid in the description of the trailing end binding operation effected by the stapler.

When the second sensor 118 detects the leading end of the bundle of sheets S, the conveyance is further made in a prescribed amount proper for the sheet size and then the conveyance of the bundle of sheets S is stopped. After this conveyance of the bundle of sheets S has been stopped, the stapling treatment is performed on the bundle of sheets S (FIG. 20 refers).

After this stapling treatment has been completed, the conveyance of the bundle of sheets S by the second sheet bundle conveying rollers 116 and 117 is resumed and the bundle of sheets S is nipped and conveyed directly in the direction of the accumulating tray part 600.

The present embodiment contemplates locating the stapling position on the basis of the position of the second sensor 118 for the following reason. The stapling position, as already described above, is such that the distance of conveyance to the stapling position in the operation of the leading end bind is different from that in the operation of the center bind or the trailing end bind.

With reference to FIG. 4, in the case of the leading end bind, the distance of conveyance of the leading end of the bundle of sheets on the basis of the leading end stopper 409 is the sum of the interval A of FIG. 4 plus the stock for binding of the leading end (about 10 mm). In contrast, in the case of the center bind and the trailing end bind, the distance will naturally cover the conveyance from the leading end of the bundle of sheets to the central part or to the trailing end part of the bundle of sheets if the control by the second sensor 118 contemplated by the present embodiment is omitted. As a result, the distance of conveyance is long as compared with the case of the leading end bind and the error of the stapling position due to the conveyance is liable to occur. In contrast, when the control is effected by means of the second sensor 118 as described above, the distance of conveyance equivalent to the interval B (the distance from the blocking part 409*b* of the leading end stopper 409 to the sensor 118) does not need to be controlled in any way because the location of the stapling position is effected after the leading end of the bundle of sheets has been conveyed over the distance of the interval B shown in FIG. 4 and the leading end of the bundle of sheets has been consequently detected by the sensor 118. If an error occurs during the conveyance over the interval B, it will give rise to no error in the stapling position. Thus, the distance of conveyance actually required in locating the stapling position is reduced by a distance equivalent to the interval B and the accuracy of the location of the stapling position during the conveyance of the bundle of sheets is proportionately improved.

In the present embodiment, the second sensor 118 is disposed near the downstream side of the second sheet bundle conveying rollers 116 and 117 which are installed on the downstream side of the stapler 500. Even when the bundle of sheets during the course of conveyance is stuck in the stapler, the conveying path laid en route thereto, or the second sheet bundle conveying rollers 116 and 117 and consequently suffered to induce a serious error in the conveyance thereof, however, the error in the stapling position due to such a serious error of conveyance as occurs in the conveying paths can be prevented because the leading end of the bundle of sheets is detected after it has passed through the possible sites of trouble enumerated above owing to the layout of the second sensor 118 mentioned above. When the bundle of sheets sticks in and blocks the conveying path and the amount of the conveyance attained by the first sheet bundle conveying rollers 114 and 115 is exclusively relied on for coping with the blockage, for example, the stapling treatment is fulfilled prematurely when the amount of the conveyance made by the first sheet bundle conveying rollers 114 and 115 reaches a total which ought to have advanced the bundle of sheets to the prescribed position notwithstanding the leading end of the bundle of sheets has ceased advancing past the point of blockage. The present embodiment precludes the inconvenience of the nature described above.

Optionally, the amount of conveyance during the operation in the trailing end bind mode may be set on the basis of the position of the first sensor 137 which is disposed in the downstream of the first sheet bundle conveying rollers 114 and 115. In the conveyance of this kind, it suffices to convey the bundle of sheets in a fixed amount without reference to the size of sheet because the conveyance in the prescribed amount is effected after the first sensor 137 detects the trailing end of the bundle of sheets.

Figure 21:
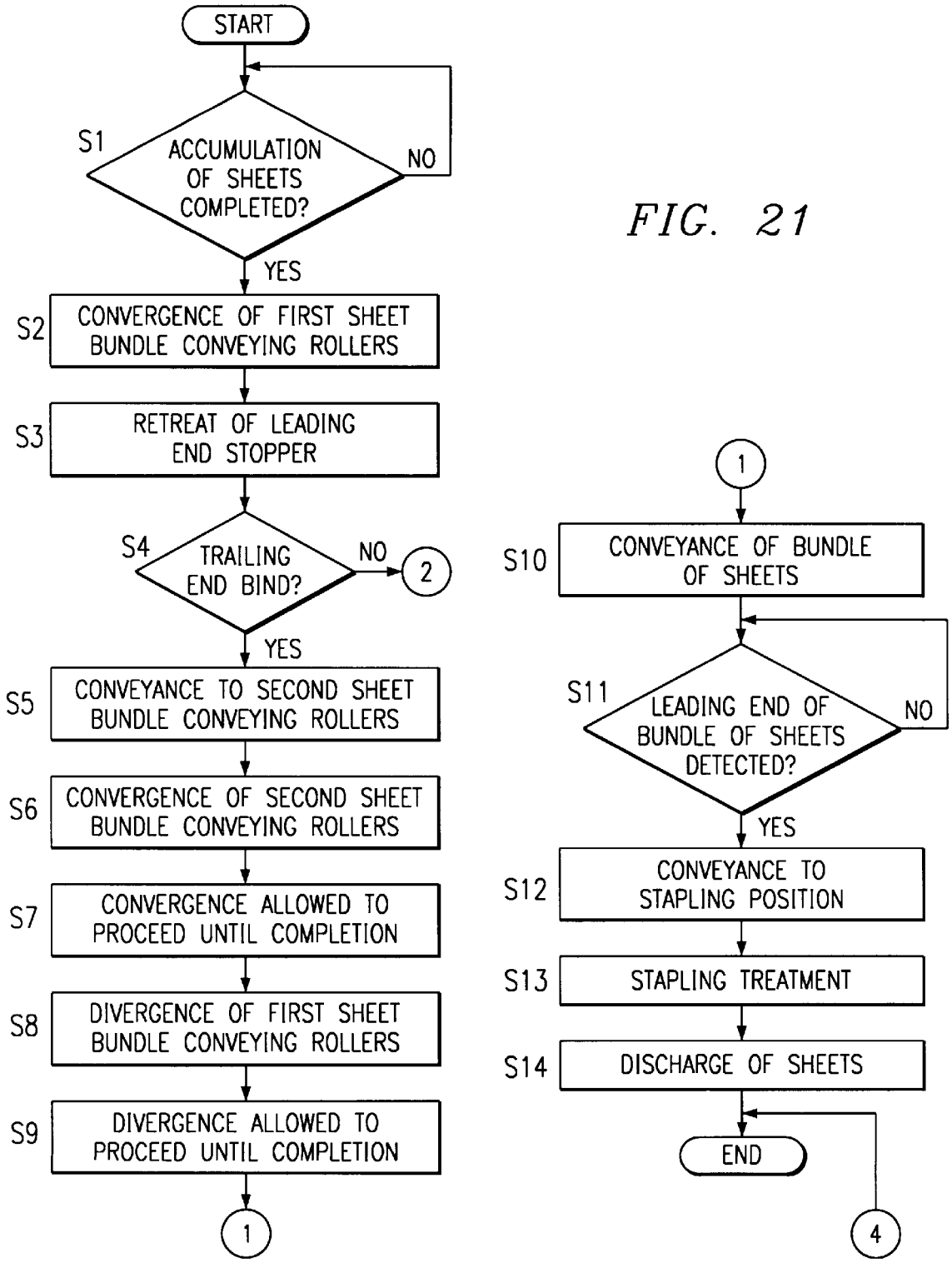
FIG. 21 is a flow chart illustrating the flow of control of the sheet bundle conveyance during the stapling treatment effected by the stapler mentioned above.
Figure 22:
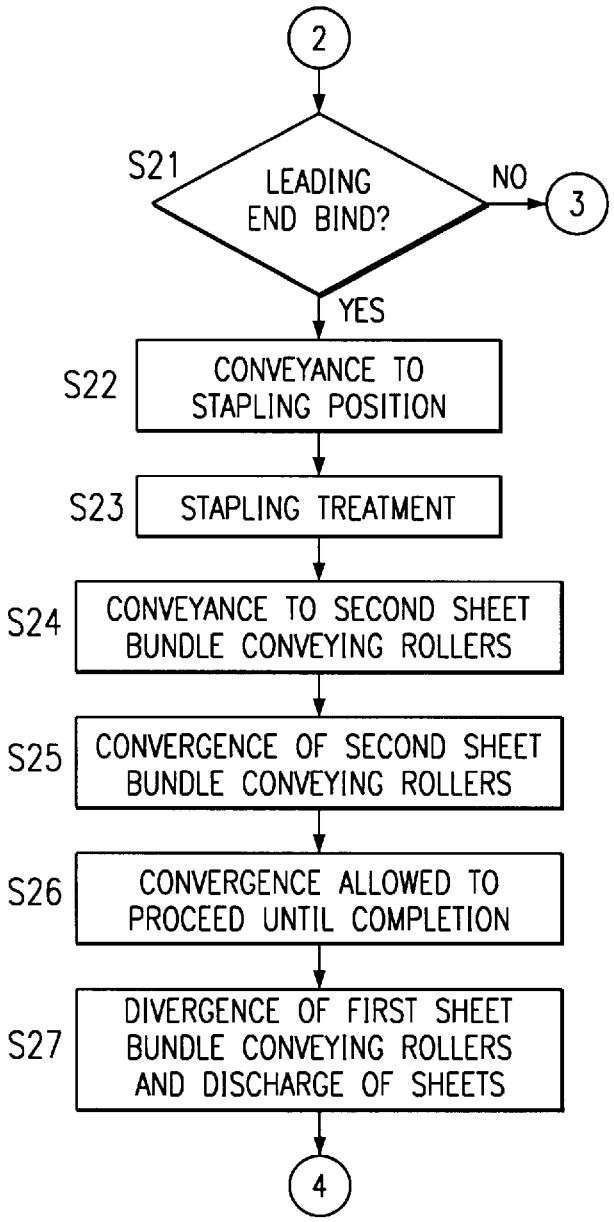
FIG. 22 is a flow chart continuing from FIG. 21 above to illustrate the flow of control of the sheet bundle conveyance during the stapling treatment effected by the stapler.
Figure 23:
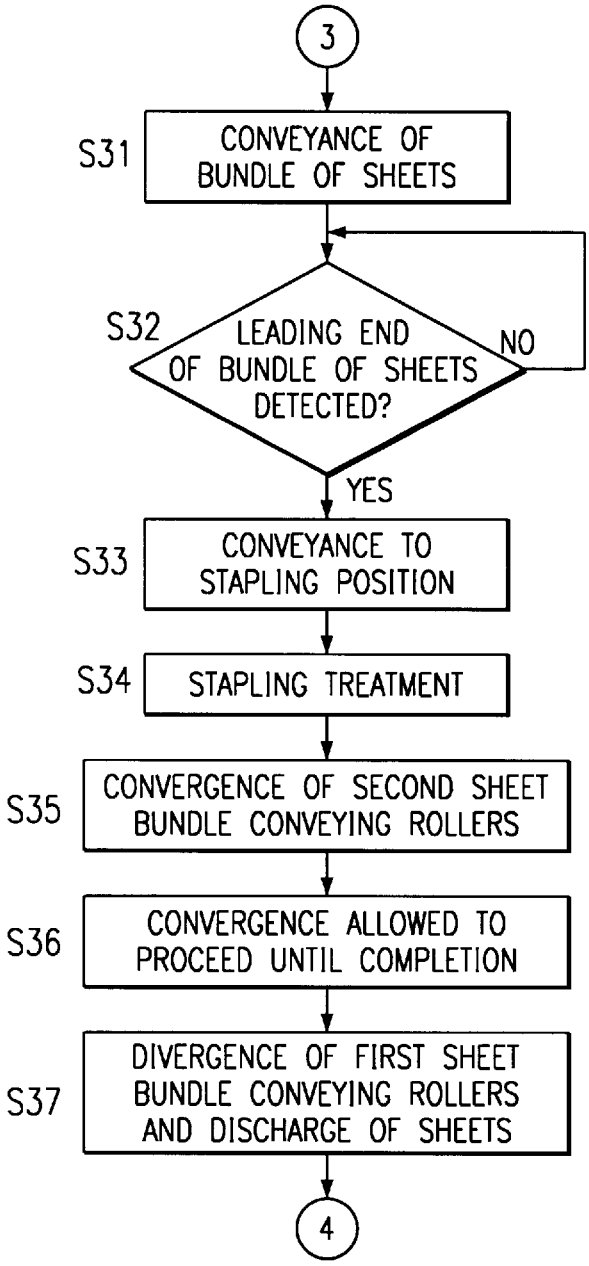
FIG. 23 is a flow chart continuing from FIG. 22 above to illustrate the flow of control of the sheet bundle conveyance during the stapling treatment effected by the stapler.

FIG. 21–FIG. 23 are flow charts showing the flow of the control effected in the conveyance of the bundle of sheets described above.

First, the aftertreating tray part 400 is examined to judge whether or not sheets for one job have been accumulated therein (S1). This decision consists in comparing the number of sheets counted by a discharged sheet detecting sensor 112 disposed near the upstream of the discharging rollers 113 and discharged into the aftertreating tray part 400 with the predetermined number of copies. When the two numbers are found to coincide, it is judged that the sheets for one job have been accumulated on the aftertreating tray part 400. The term "number of copies" as used herein refers to the number of sheets for producing thereon copies for one job which are determined by the number of original documents delivered by an ADF 12 for reading images and the copy mode set by the user (such as, for example, the doubled-face copy or the single-face copy or the N in 1 mode in which a plurality of original documents are copied on one sheet).

After the sheets for one job have been accumulated on the aftertreating tray part 400, the first sheet bundle conveying rollers 114 and 115 are moved toward each other until they nip the bundle of sheets (S2). Subsequently, the leading end stopper 409 is retreated (S3).

Then, the status of operation is examined to judge whether or not the operation is in the trailing end bind (S4).

When the mode of the trailing end bind is established, the bundle of sheets is conveyed until it reaches the second sheet bundle conveying rollers 116 and 117 (S5). Then, the conveyance is discontinued and the second sheet bundle conveying rollers 116 and 117 are moved toward each other until convergence (S6).

The prescribed time which is required for the second sheet bundle conveying rollers 116 and 117 to nip the bundle of sheets thoroughly is allowed to pass (S7) before the first sheet bundle conveying rollers 114 and 115 are separated from each other (S8). Then, the prescribed time required for complete divergence of the first sheet bundle conveying rollers 114 and 115 from the bundle of sheets is allowed to pass (S9).

Then, the conveyance of the bundle of sheets is resumed (S10). When the sensor 118 detects the leading end of the bundle of sheets (S11), the conveyance of the bundle of sheets is continued, depending on the size of sheet and is stopped after the bundle of sheets (the trailing end part thereof in this case) reaches the stapling position (S12). The stapling treatment is performed on the bundle of sheets (S13) and the stapled bundle of sheets is discharged (S14).

When the judgment at the step S4 mentioned above does not find the operation to be in the trailing end bind mode, the status of operation is examined to judge whether or not the operation is in the leading end bind mode (S21).

When the leading end bind mode is established, the bundle of sheets is conveyed to and stopped at the stapling position (the leading end part thereof in this case) (S22) and the stapling treatment is performed (S23).

Subsequently, the conveyance of the bundle of sheets is continued until the bundle reaches the second sheet bundle conveying rollers 116 and 117 and it is discontinued (S24). The second sheet bundle conveying rollers 116 and 117 are moved toward each other until convergence (S25).

The prescribed time which is required for the second sheet bundle conveying rollers 116 and 117 to nip the bundle of sheets thoroughly is allowed to pass (S26). Then, the first sheet bundle conveying rollers 114 and 115 are diverged and, at the same time, the conveyance of the bundle of sheets is resumed to discharge the bundle of sheets (S27).

Then, when the judgment at the step S21 mentioned above finds the operation not to be in the leading end bind mode but in the center bind mode, the conveyance of the bundle of sheets is effected (S31). When the sensor 118 detects the leading end of the bundle of sheets (S32), the conveyance of the bundle of sheets is continued, depending on the size of sheet. This conveyance is stopped when the bundle of sheets reaches the stapling position (the central part of sheet in this case) (S33) and the stapling treatment is performed (S34).

Then, the second sheet bundle conveying rollers 116 and 117 are moved toward each other until convergence (S35). Subsequently, the prescribed time which is required for the second sheet bundle conveying rollers 116 and 117 to nip the bundle of sheets thoroughly is allowed to pass (S36) and the first sheet bundle conveying rollers 114 and 115 are separated from each other and, at the same time, the conveyance of the bundle of sheets is resumed to discharge the bundle of sheets (S37).

<<Sheet conveying drive system>>

Figure 24:
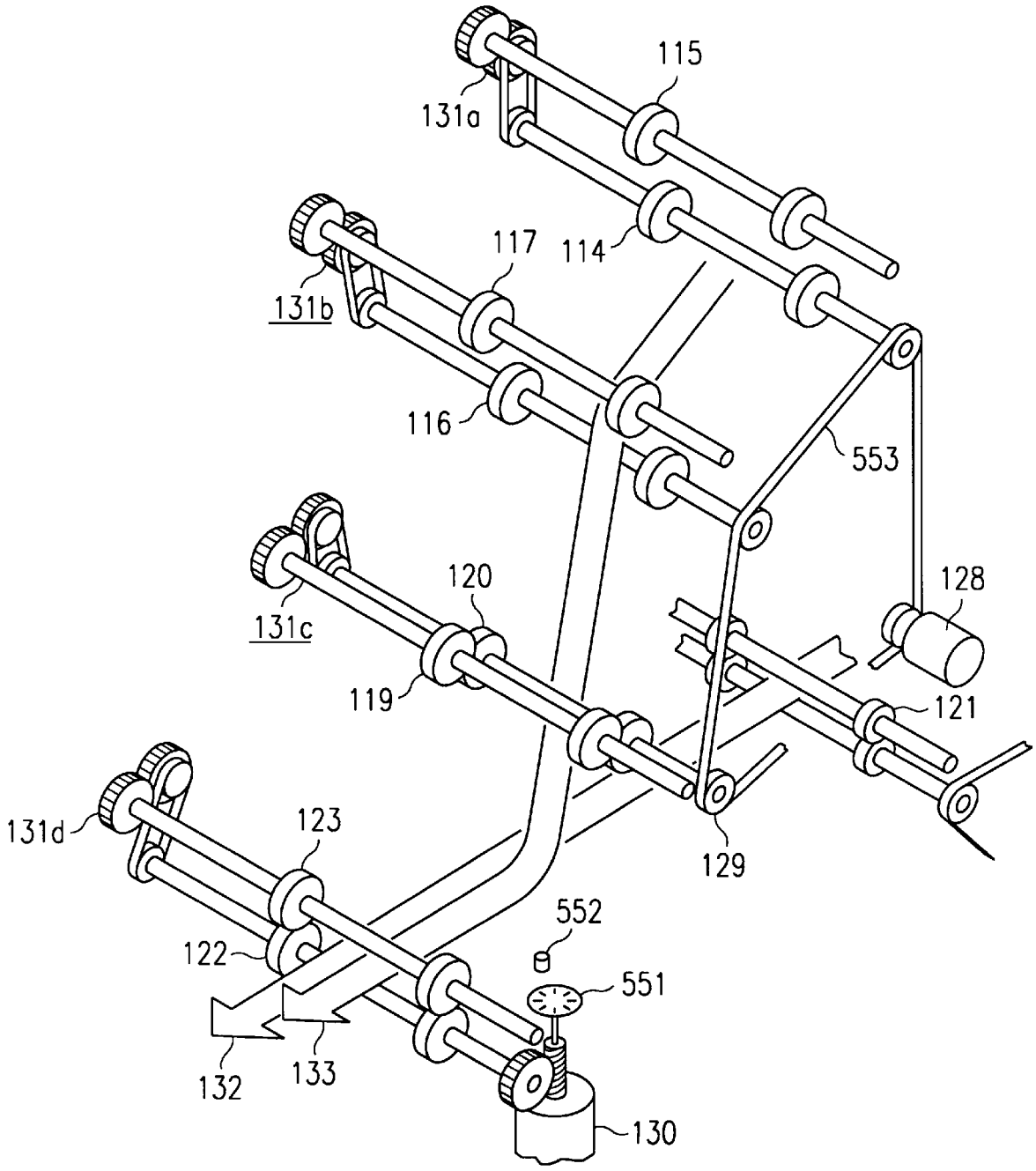
FIG. 24 is a diagram of an artist concept of the construction of a drive system for the conveyance of a bundle of sheets in the finisher mentioned above.

FIG. 24 is a perspective view representing an artist's concept of a sheet conveying system for conveying a stapled bundle of sheets and a lone non-stapled sheet in the direction of the accumulating tray part 600. In this diagram, the positional relation of the component rollers is different from that illustrated in FIG. 2 for the sake of facilitating the comprehension of the conveying paths.

In the accumulating tray part 600, a bundle of sheets which had been discharged from the aftertreating tray 401 and subjected to a stapling treatment in the stapler 500 and a lone sheet conveyed through other conveying paths and subjected to no stapling treatment are both accumulated.

The conveying system leading to the accumulating tray part 600, as illustrated in the diagram, comprises third sheet bundle conveying rollers 119 and 120 for conveying a bundle of sheets, conveying rollers 121 disposed in the downstream of a switch claw 103 and adapted to convey a lone sheet, and discharging rollers 122 and 123 for delivering a bundle of sheets or a lone sheet into the accumulating tray part 600 in addition to the first and second sheet bundle conveying rollers 114 and 115, and 116 and 117.

The discharging rollers 122 and 123 are rotationally driven by a DC motor 130 independently of the other rollers. A pulse disc 551 is mounted on the DC motor 130. The speeds of rotation of the discharging rollers 122 and 123 are controlled in accordance with the number of output pulses of the pulse disc 551 detected by the pulse detecting sensor 552.

The first, second, and third sheet bundle conveying rollers 114 and 115, 116 and 117, and 119 and 120 are driven by one stepping motor 128 through the medium of a belt 553. The third sheet bundle conveying rollers 119 and 120 are connected to the stepping motor 128 through the medium of a one-way clutch 129 mounted on the shaft of the roller 120. The one-way clutch 129 is freely rotated in the direction of allowing the bundle of sheets to be moved in the direction of conveyance of sheets even when the stepping motor 128 is in a suspended state.

The other rollers such as, for example, the conveying rollers 121 which are disposed in the sheet conveying paths are invariably driven by other DC motors not shown in the diagram.

The discharging rollers 122 and 123 is required to convey stably both a lone sheet which has not undergone a stapling treatment and bundle of sheets which has a varying thickness and has undergone a stapling treatment. To meet the requirement, they are each formed of a roller which uses a material of low hardness. In order for the two rollers to admit a thick bundle of sheets, the upper roller 123 is endowed with a large relief and adapted to exhibit relatively weak pressing force to the lower roller 122. To allow uniform conveyance of the upper portion and the lower portion of one bundle of sheets, drive transmitting mechanisms 131*a*–131*d* provided with at least one idle part capable of transmitting the drives of the lower rollers 114, 116, 120, and 122 respectively to the upper rollers 115, 117, 119, and 123 are provided. In the diagram, the reference numeral "132" denotes the conveying path for conveying a lone sheet and the reference numeral "133" the conveying path for a bundle of sheets.

[Operation of discharging bundle of sheets or lone sheet to accumulating tray part 600]

As already described, the bundle of sheets accumulated on the aftertreating tray 401 is nipped and conveyed by the first sheet bundle conveying rollers 114 and 115 or the second sheet bundle conveying rollers 116 and 117, depending on the stapling mode, located at the stapling position, subjected to the stapling treatment, and again conveyed by the second sheet bundle conveying rollers 116 and 117. The first and second sheet bundle conveying rollers 114 and 115, and 116 and 117 are rotationally driven exclusively by one stepping motor 128. The stepping motor 128 rotationally drives the third sheet bundle conveying rollers 119 and 120 as well. The sheet bundle conveying path 133, in the downstream of the third sheet bundle conveying rollers 119 and 120, joins the conveying path 132 serving the purpose of conveying a lone sheet. The bundle of sheets, therefore, advances through the discharging rollers 122 and 123 and reaches the accumulating tray part 600. The discharging rollers 122 and 123 are rotationally driven exclusively by the DC motor 130. The speeds of rotation of the rollers 122 and 123 are controlled in accordance with the number of output pulses from the pulse disc 551.

The second sheet bundle conveying rollers 116 and 117 are separated from each other after the stapled bundle of sheets is conveyed through the sheet bundle conveying path 133 and the leading end of the bundle of sheets is thoroughly engulfed by the third sheet bundle conveying rollers 119 and 120 provided with the one-way clutch 129. The first sheet bundle conveying rollers 114 and 115 resume the conveyance of the bundle of sheets after the stapling treatment is completed. They are already in a separated state by the time the bundle of sheets is thoroughly nipped by the third sheet bundle conveying rollers 119 and 120.

When the first sensor 137 detects the fact that the trailing end of the bundle of sheets has passed the leading end stopper 409, it resets the leading end stopper 409, closes the sheet discharging outlet 401*a* of the aftertreating tray 401, and starts the temporary accumulation of sheets for the subsequent stapling treatment (the next job).

The stepping motor 128 is stopped after the bundle of sheets has been further conveyed and the leading end of the bundle of sheets has been thoroughly nipped by the discharging rollers 122 and 123. By this time, the rotational drive of the discharging rollers 122 and 123 has been started. Since the third sheet bundle conveying rollers 119 and 120 are provided with the one-way clutch 129 and further since the first and second sheet bundle conveying rollers 114–117 are each in a separated state, the bundle of sheets is continuously conveyed and accumulated in the accumulating tray part 600.

The distance between the leading end stopper 409 and the discharging rollers 122 and 123 is set such that the leading end of the bundle of sheets for the previous job amply reaches the discharging rollers 122 and 123 before the temporary accumulation of sheets for the next job is completed, without reference to the size of sheet and the number of sheets. The stepping motor 128, therefore, has ceased operation by the time the temporary accumulation of sheets for the next job is completed. As a result, at the time that the accumulation of sheets for the next job is completed, the first sheet bundle conveying rollers 114 and 115 can be converged until pressure contact and the start of the stapling treatment on the bundle of sheets for the next job does not need to be delayed.

<<Finisher control system>>

Figure 25:
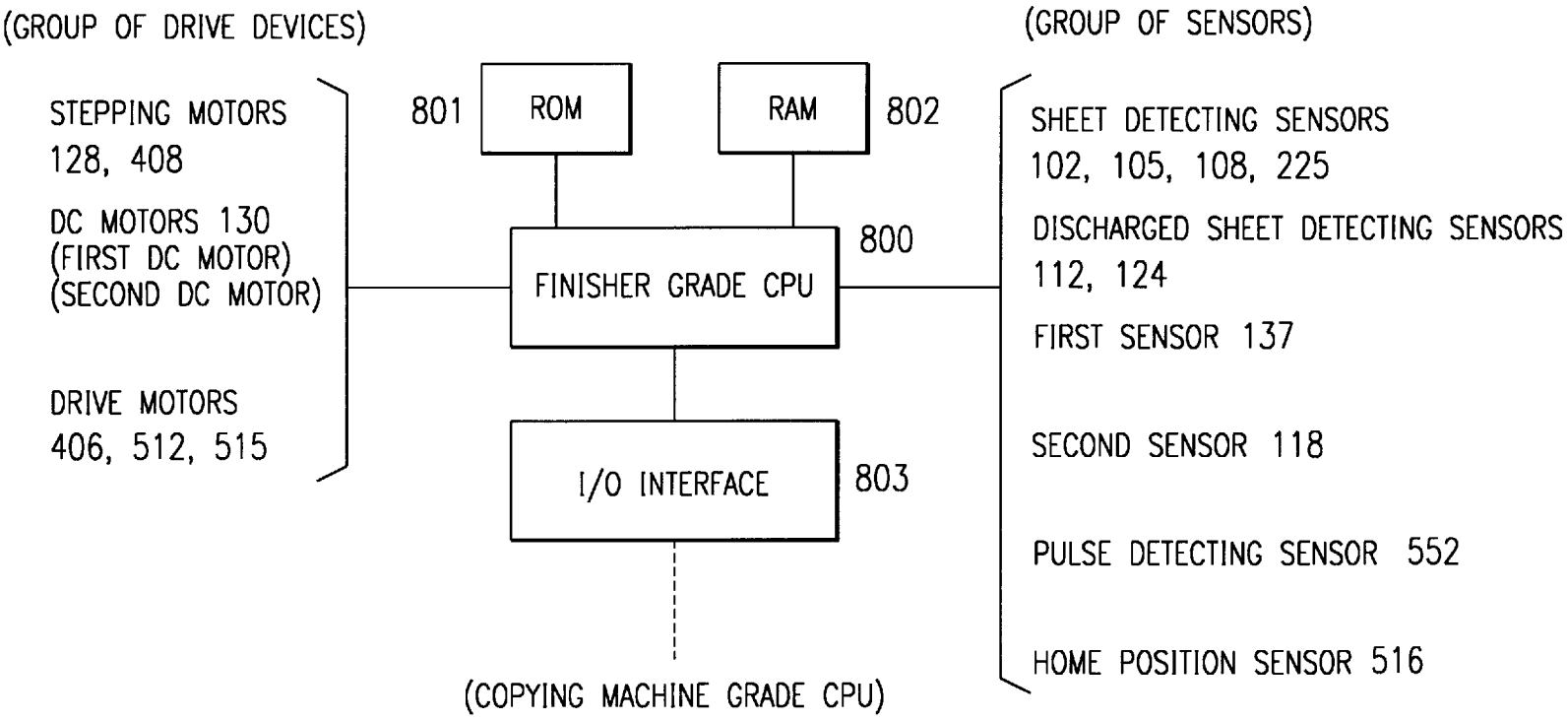
FIG. 25 is a block diagram illustrating the construction of the control system in the finisher mentioned above.

FIG. 25 is a block diagram of a control system serving the purpose of controlling the components of the finisher described above.

The components of the finisher are controlled by a well-known microcomputer. As illustrated in the diagram, they include a CPU 800 for executing various programs and controlling the operations of the various components of the finisher, a ROM 801 for memorizing the basic program of the CPU 800 and the control programs of the components of the finisher, a RAM 802 to be used as a working area by the CPU 800, the various sensors (sensor groups) and various drive devices (drive device groups) already explained as constituent elements for the finisher, and an I/O interface 803 for connecting the sensor groups and the drive device groups to the CPU 800. The CPU 800 is connected to a copying machine grade CPU through the medium of the I/O interface 803 for the purpose of exchanging signals and data with the copying machine grade CPU.

This control system enables the components of the finisher to carry out their operation as already described in detail by executing the programs necessary for the operations of the components of the finisher and actuating the drive devices of the components of the finisher in response to the signals from the sensors.

The entire disclosure of Japanese Patent Application No. 09-058126 filed on Mar. 12, 1997, including the specification, claims, drawings and summary are incorporated herein by reference in its entirety.

What is claimed is:

1. A finisher incorporating therein a stapling device for accumulating a plurality of sheets and performing a stapling treatment on a bundle of accumulated sheets, comprising:

a first sheet bundle conveying device disposed on the upstream side of said stapling device relative to the direction of conveyance of said bundle of sheets and formed of a pair of rollers capable of being pressed against each other and separated from each other;

a second sheet bundle conveying device disposed on the downstream side of said stapling device relative to the direction of conveyance of said bundle of sheets and formed of a pair of rollers capable of being pressed against each other and separated from each other; and a sheet end detecting device disposed near the downstream side of said second sheet bundle conveying device and adapted to detect the leading end of said bundle of sheets in the direction of conveyance.

2. A finisher according to claim 1, which further comprises a straight sheet conveying guide disposed between said first sheet bundle conveying device and said sheet end detecting device.

3. A finisher according to claim 1, wherein said stapling device comprises a head unit and an anvil unit which are moved independently of each other.

4. A finisher according to claim 1, wherein said stapling device performs a stapling treatment on said bundle of sheets in the neighborhood of the leading end thereof in the direction of conveyance.

5. A finisher according to claim 4, wherein said stapling device performs a stapling treatment on said bundle of sheets nipped by said first sheet bundle conveying device in the neighborhood of the leading end thereof in the direction of conveyance.

6. A finisher according to claim 1, wherein said stapling device performs a stapling treatment on said bundle of sheets in the neighborhood of the trailing end thereof in the direction of conveyance.

7. A finisher according to claim 6, wherein said stapling device performs a stapling treatment on said bundle of sheets nipped by said second sheet bundle conveying device in the neighborhood of the trailing end thereof in the direction of conveyance.

8. A finisher according to claim 6, wherein said stapling device performs a stapling treatment after said sheet end detecting device has detected the leading end of said bundle of sheets and said second sheet bundle conveying device has conveyed said bundle of sheets in a prescribed amount and then stopped.

9. A finisher according to claim 1, wherein said stapling device performs a stapling treatment on said bundle of sheets in the neighborhood of the center thereof in the direction of conveyance.

10. A finisher according to claim 9, wherein said stapling device performs a stapling treatment on said bundle of sheets nipped by said second sheet bundle conveying device in the neighborhood of the center thereof in the direction of conveyance.

11. A finisher according to claim 9, wherein said stapling device performs a stapling treatment after said sheet end detecting device has detected the leading end of said bundle of sheets and said second sheet bundle conveying device has conveyed said bundle of sheets in a prescribed amount and then stopped.

12. A finisher according to claim 1, which is connected to an image forming apparatus for forming an image on a sheet.

13. A finisher incorporating therein a working device for accumulating a plurality of sheets and performing a work on a bundle of accumulated sheets, comprising:

a first sheet bundle conveying device disposed on the upstream side of said working device relative to the direction of conveyance of said bundle of sheets;

a second sheet bundle conveying device disposed on the downstream side of said working device relative to the direction of conveyance of said bundle of sheets; and a sheet end detecting device disposed in the neighborhood of the downstream side of said second sheet bundle conveying device and adapted to detect the leading end of said bundle of sheets in the direction of conveyance.

14. A finisher according to claim 13, which further comprises a straight sheet conveying guide disposed between said first sheet bundle conveying device and said sheet end detecting device.

15. A finisher according to claim 13, wherein said working device performs a work on said bundle of sheets in the neighborhood of the leading end thereof in the direction of conveyance.

16. A finisher according to claim 15, wherein said working device performs a work on said bundle of sheets nipped by said first sheet bundle conveying device in the neighborhood of the leading end thereof in the direction of conveyance.

17. A finisher according to claim 13, wherein said working device performs a work on said bundle of sheets in the neighborhood of the trailing end thereof in the direction of conveyance.

18. A finisher according to claim 17, wherein said working device performs a work on said bundle of sheets nipped by said second sheet bundle conveying device in the neighborhood of the trailing end thereof in the direction of conveyance.

19. A finisher according to claim 17, wherein said working device performs a work after said sheet end detecting device has detected the leading end of said bundle of sheets and said second sheet bundle conveying device has conveyed said bundle of sheets in a prescribed amount and then stopped.

20. A finisher according to claim 13, wherein said working device performs a work on said bundle of sheets in the neighborhood of the center thereof in the direction of conveyance.

21. A finisher according to claim 20, wherein said working device performs a work on said bundle of sheets nipped by said second sheet bundle conveying device in the neighborhood of the center thereof in the direction of conveyance.

22. A finisher according to claim 20, wherein said working device performs a work after said sheet end detecting device has detected the leading end of said bundle of sheets and said second sheet bundle conveying device has conveyed said bundle of sheets in a prescribed amount and then stopped.

23. A finisher according to claim 13, which is connected to an image forming apparatus for forming an image on a sheet.

24. A method for stapling sheets, comprising:

a step of accumulating a plurality of sheets emanating from an image forming apparatus;

a step of nipping a bundle of accumulated sheets by the use of a first sheet bundle conveying device formed of a pair of rollers capable of converging toward and diverging from said bundle;

a first step of conveying said nipped bundle of sheets, a step of receiving and stapling said bundle of sheets by the use of a stapling device;

a second step of conveying the stapled bundle of sheets by the use of said first sheet bundle conveying device;

a step of receiving and nipping said bundle of sheets by the use of a second sheet bundle conveying device formed of a pair of rollers capable of converging toward and diverging from said bundle of sheets;

a step of separating said first sheet bundle conveying device from said bundle of sheets nipped by said second sheet bundle conveying device; and a third step of conveying said nipped bundle of sheets by the use of said second sheet bundle conveying device.

25. A method according to claim 24, wherein said first sheet bundle conveying device conveys said bundle of sheets over a prescribed distance from a sensor disposed in the upstream of said stapling device and then stops during said first step of conveying said bundle of sheets.

26. A stapling method, comprising:

a step of accumulating a plurality of sheets emanating from an image forming apparatus;

a step of nipping a bundle of accumulated sheets by the use of a first sheet bundle conveying device formed of a pair of rollers capable of converging toward and diverging from said bundle of sheets;

a first step of conveying the nipped bundle of sheets;

a step of receiving and stapling said bundle of sheets by the use of a stapling device;

a step of nipping the stapled bundle of sheets by the use of a second sheet bundle conveying device formed of a pair of rollers capable of converging toward and diverging from said bundle of sheets;

a step of separating said first sheet bundle conveying device from said bundle of sheets nipped by said second sheet bundle conveying device; and a second step of conveying the stapled bundle of sheets by the use of said second sheet bundle conveying device.

27. A method according to claim 26, wherein said first sheet bundle conveying device conveys said bundle of sheets over a prescribed distance from a sensor disposed in the downstream of said stapling device and then stops during said first step of conveying said bundle of sheets.

28. A stapling method, comprising:

a step of accumulating a plurality of sheets emanating from an image forming apparatus;

a step of nipping a bundle of accumulated sheets by the use of a first sheet bundle conveying device formed of a pair of rollers capable of converging toward and diverging from said bundle of sheets;

a first step of conveying the nipped bundle of sheets;

a step of receiving and nipping said bundle of sheets by the use of a second sheet bundle conveying device formed of a pair of rollers capable of converging toward and diverging from said bundle of sheets;

a step of separating said first sheet bundle conveying device from said bundle of sheets nipped by said second sheet bundle conveying device;

a second step of conveying the nipped bundle of sheets by the use of said second sheet bundle conveying device;

a step of receiving and stapling said bundle of sheets by the use of a stapling device; and a third step of conveying the stapled bundle of sheets by the use of said second sheet bundle conveying device.

29. A method according to claim 28, wherein said second sheet bundle conveying device conveys said bundle of sheets over a prescribed distance from a sensor disposed in the downstream of said stapling device and then stops during said second step of conveying said bundle of sheets.

* * * * *